US005252954A

United States Patent [19]

Nagata et al.

[11] Patent Number: 5,252,954

[45] Date of Patent: Oct. 12, 1993

[54] MULTIPLEXED DRIVING METHOD FOR AN ELECTROOPTICAL DEVICE, AND CIRCUIT THEREFOR

[75] Inventors: Tetsuya Nagata, Hitachi; Takao Umeda, Mito; Tatsuo Igawa, Kita Ibaraki, all of Japan

[73] Assignee: Hitachi, Ltd., Tokyo, Japan

[21] Appl. No.: 492,588

[22] Filed: Mar. 13, 1990

[30] Foreign Application Priority Data

Mar. 13, 1989 [JP] Japan ..... 1-60093

[51] Int. Cl.[5] ..... G09G 3/36

[52] U.S. Cl. ..... 345/95; 345/210

[58] Field of Search ..... 340/784, 805, 765; 350/331, 332, 333, 350 S; 359/56, 54, 55

[56] References Cited

U.S. PATENT DOCUMENTS

| | | | |
|---|---|---|---|
| 4,746,196 | 5/1988 | Umeda et al. | 350/333 |
| 4,769,659 | 9/1988 | Umeda et al. | 350/350 S |
| 4,834,510 | 5/1989 | Fujita | 340/805 |
| 4,907,859 | 3/1990 | Takada et al. | 340/331 T |
| 5,041,821 | 8/1991 | Onitsuka et al. | 359/56 |

FOREIGN PATENT DOCUMENTS

| | | | |
|---|---|---|---|
| 3631151 | 3/1987 | Fed. Rep. of Germany . | |
| 0249024 | 11/1986 | Japan | 350/350 S |
| 62-56933 | 3/1987 | Japan . | |
| 62-116925 | 5/1987 | Japan . | |
| 63-210825 | 9/1988 | Japan . | |
| 64-24234 | 1/1989 | Japan . | |
| 64-72869 | 3/1989 | Japan . | |
| 2207794 | 2/1989 | United Kingdom | 340/784 |

OTHER PUBLICATIONS

National Technical Report, vol. 33, No. 1, Feb. 1987, pp. 44–50.

*Primary Examiner*—Alvin E. Oberley
*Assistant Examiner*—Chanh Nguyen
*Attorney, Agent, or Firm*—Antonelli, Terry, Stout & Kraus

[57] ABSTRACT

A driving method is provided for an electrooptical device having scanning and signal electrodes arranged in a matrix with a plurality of picture elements formed in association with intersections of the electrodes. Voltages of high-frequency pulses are applied to both the scanning and signal electrodes, and a DC voltage pulse for setting the optical state of the electrooptical material is applied to the picture elements during a selected period for the scanning electrodes, while a high-frequency AC voltage for holding the previously set optical state of the electrooptical material is applied to the picture elements during a non-selected period for the scanning electrodes. A circuit is also provided for carrying out the method, and an electrooptical apparatus is provided employing the electrooptical device described above.

8 Claims, 21 Drawing Sheets

| SELECTION CONTROL SIGNAL | AC-CONVERTING SIGNAL 1 | AC-CONVERTING SIGNAL 2 | OUTPUT VOLTAGE |
|---|---|---|---|
| 0 | 0 | 0 | Va |
| 0 | 0 | 1 | Vd |
| 0 | 1 | 0 | Va |
| 0 | 1 | 1 | Vd |
| 1 | 0 | 0 | Vd |
| 1 | 0 | 1 | Vb |
| 1 | 1 | 0 | Vc |
| 1 | 1 | 1 | Va |

| DATA SIGNAL | AC-CONVERTING SIGNAL | OUTPUT VOLTAGE |
|---|---|---|
| 0 | 0 | Vh |
| 0 | 1 | Vf |
| 1 | 0 | Vg |
| 1 | 1 | Ve |

FIG. 34

| | | | | |
|---|---|---|---|---|
| STATES OF PICTURE ELEMENTS OF LIQUID CRYSTAL DEVICE 49a | LIGHT | LIGHT | DARK | DARK |
| STATES OF PICTURE ELEMENTS OF LIQUID CRYSTAL DEVICE 49b | LIGHT | DARK | LIGHT | DARK |
| OUTPUT 51 | LIGHT | DARK | DARK | DARK |

FIG. 35

| | | | | |
|---|---|---|---|---|
| STATES OF PICTURE ELEMENTS OF LIQUID CRYSTAL DEVICE 49a | LIGHT | LIGHT | DARK | DARK |
| STATES OF PICTURE ELEMENTS OF LIQUID CRYSTAL DEVICE 49b | LIGHT | DARK | LIGHT | DARK |
| OUTPUT 51 | LIGHT | LIGHT | LIGHT | DARK |

MULTIPLEXED DRIVING METHOD FOR AN ELECTROOPTICAL DEVICE, AND CIRCUIT THEREFOR

BACKGROUND OF THE INVENTION a. Field of the Invention

This invention relates to an electrooptical device using an electrooptical material such as ferroelectric liquid crystal, a method and a circuit for driving the device, and further relates to an electrooptical apparatus employing the electrooptical device.

b. Background Art

Liquid crystal has been widely known as an electrooptical material. Especially, ferroelectric liquid crystal has attracted special interest recently.

A general form of an electrooptical device using the ferroelectric liquid crystal will now be described with reference to FIGS. 2, 3 and 4, which are used for explaining the general idea of the common electrooptical device, but which do not show a specific prior art structure.

The electrooptical device employing the ferroelectric liquid crystal comprises glass plates 2 each having a transparent electrode 3 and alignment layer 4 coated thereon, spacers 6 interposed between the glass plates 2 to space the glass plates 2 from each other and to keep them at a given distance, ferroelectric liquid crystal 5 sealed in a space defined between the glass plates 2, and a polarizer or polarizers 1 placed on either side of the glass plate 2, as illustrated in the FIGURES.

In case the ferroelectric liquid crystal is of a chiral smectic C phase, ferroelectric liquid crystal molecules 7 show spontaneous polarization 8 in a direction perpendicular to longitudinal axes (major axes) of the molecules. The ferroelectric liquid crystal molecules 7 may be aligned in layers 9 which extend in a direction perpendicular to the major surfaces of the glass plates 2 by selecting the alignment layer 4. In the thus-aligned state, the ferroelectric liquid crystal molecules 7 may move substantially along a conical path 10, while keeping a tilt angle $\theta$ with reference to a normal line 13 of the layer 9.

When an electric field 11 is applied in a direction perpendicular to the major surfaces of the glass plates 2, the liquid crystal molecules 7 may be put into either of two stable positions 12*a*, 12*b* which are parallel with the glass plates 2, depending upon a direction of the electric field applied thereto. These two positions are diagrammatically illustrated in FIGS. 4 (*a*) and (*b*), respectively, wherein the ferroelectric liquid crystal molecules are shown as being applied with an electric field E (11*a*) which is directed toward the farther side of the drawing sheet from this side of the sheet and as being applied with an electric field E (11*b*) which is directed toward this side from the farther side, respectively. Thus, the ferroelectric liquid crystal molecules 7 assume the positions (a) or (*b*) at a tilting angle of $+\theta$, depending upon the direction of the electric field applied thereto. This effect may be combined with a birefringent effect or a guest-host effect of the liquid crystal to provide two, i.e., dark and light, states in which light is transmitted in the same direction as the electric field or light is cut out according to the direction of the electric field applied respectively.

It is assumed in the following description, for the sake of convenience, that an ON-state which allows light transmission is developed when a positive voltage sufficient to put the ferroelectric liquid molecules into one of the positions is applied to the molecules, and that an OFF-state which cuts off light is developed when a sufficient negative voltage is applied.

When the thickness of a liquid crystal layer is reduced to 2 μm or so, a threshold effect, such as a memory effect, will be observed. This memory effect may be utilized in an electrooptical device of matrix-arranged electrodes consisting of scanning electrodes and signal electrodes arranged in rows and columns and providing picture elements at intersections of the electrodes. In this device, the scanning electrodes may be selected sequentially, and only the picture elements on the selected electrode may be applied with an electric field whose magnitude is sufficiently larger than a threshold value to set the states of the picture elements, while picture elements on the non-selected electrodes may be applied with an electric field smaller in magnitude than the threshold value to hold the picture elements in the previously set states. Thus, multiplexed driving can be attained.

On the other hand, it has been known that, when an AC electric field, whose frequency is so high that the response based on the spontaneous polarization can not follow the changes of the electric field, is applied to ferroelectric liquid crystal molecules having a negative dielectric anisotropy, a dielectric torque may be produced, which acts to put the liquid crystal molecules 7 parallel with the glass plates 2. This phenomenon is called AC field-stabilization, and it does not depend on a thickness of the liquid crystal layer. This means that, even when the ferroelectric liquid crystal layer has a substantial thickness, it may have a memory effect by the AC field-stabilization effect. This effect may effectively be utilized to enable multiplexed driving of the liquid crystal device which is thick enough to be manufactured easily.

A driving method for the ferroelectric liquid crystal device of the kind is disclosed, for example, in Publication of Japanese Unexamined Patent Application (KOKAI) No. 62-116925. This publication shows a set of driving waveforms as given in FIG. 5. A voltage for putting an electrooptical device into a desired state and an AC high-frequency voltage for holding the state are applied to accomplish the multiplexed driving of the electrooptical device. The method disclosed in this publication further teaches that an initialization signal is applied prior to supplying a selection signal, thereby to put the picture elements once off for every scanning.

Another example of background art is disclosed in National Technical Report Vol. 33, No. 1, Feb. 1987, pp. 44–50. This paper shows driving waveforms as given in FIG. 6. A completely symmetrical AC voltage, in which no bias voltage is applied, is given during a non-selected period. This assures high contrast.

These examples of background art, however, involve some problems, which will be described below.

According to the former first described example of background art, a symmetrical voltage with respect to a zero level is applied for initialization. At this time, a first half of the voltage pulse will forcibly turn on the electrooptical device. Even if an OFF signal is continuously applied to the signal electrode, an ON-state will occur intermittently. This will lower the contrast which is defined by:

$$\frac{\text{Transmitted light amount during ON-period}}{\text{Transmitted light amount during OFF-period}}$$

In addition, positive and negative bias voltages corresponding to voltages applied to the signal electrodes are superposed in the high-frequency AC voltage during the non-selection period. The bias voltages influence adversely both the ON-state and OFF-state, lowering the contrast. A high-level, high-frequency AC voltage is needed to suppress the lowering of the contrast. This voltage must be completely supplied from the scanning electrode side. This inevitably increases the voltage to be applied to the scanning electrodes.

The second example of background art does not need voltage pulses for the initialization, and it can assure high contrast because of symmetrical high-frequency AC voltage applied during the non-selection period. In fact, however, a voltage of an amplitude twice the amplitude of the symmetrical high-frequency AC voltage applied to the liquid crystal must be applied to all the signal electrodes. A working example of this art shows that a voltage as high as +50V is applied to a device comprising a thin liquid crystal layer of 3.5 μm thickness to drive the same. For this reason, a special high-voltage driving circuit is needed, which makes the circuit bulky and increases the power consumption.

SUMMARY OF THE INVENTION

It is an object of the present invention to provide an electrooptical device which is capable of solving the problems involved in the example of background art described above. It is another object of the present invention to provide a method for driving an electrooptical device which is capable of providing high contrast with a low drive voltage. It is a further object of the present invention to provide an electrooptical apparatus which employs the electrooptical device and utilizes the driving method mentioned above.

In accordance with the present invention, the following (1) and (2) driving methods for the electrooptical device are provided to achieve the object as given above:

(1) During a selected period for a scanning electrode, either a first DC voltage pulse whose polarities differ from the first half of the selected period to the latter half thereof is applied to set a picture element or elements to a first state, or a second DC voltage pulse of a polarity which is the same as that of the first half of the first DC voltage is applied to set a picture element or elements to a second state.

(2) After application of the DC voltage pulse, a high-frequency AC voltage is applied to the picture elements. This high-frequency AC voltage is superposed with a bias voltage of 0 or a bias voltage of one polarity. A bias voltage of another polarity is not superposed in the high-frequency AC voltage. More particularly, either the high-frequency AC voltage containing no DC bias voltage or the high-frequency AC voltage containing no bias which acts to change the picture elements to another state from the state set previously, is applied to the electrooptical material after the pulse for setting the state has been applied.

This is a first feature of the present invention. This feature and another feature as will be given later are applicable not only to the device comprising the scanning and signal electrodes, but also to a device which allows application of desired waveforms to the electrooptical material.

The inventors of the present invention have found that the first feature of the present invention shows a remarkable effect. More specifically, while the DC voltage pulse applied during the selected period is to put the picture elements of the electrooptical material into a desired state, the high-frequency AC voltage, especially the high-frequency AC voltage symmetrical with respect to 0 level, applied immediately after the application of the DC voltage pulse will promote the response of the picture elements. Therefore, it is not always required that the response be completed by the previous DC voltage pulse.

A second feature of the present invention utilizes this phenomenon as given. According to this, the duration of the DC voltage pulse to be applied for determining the states of the picture elements during the selected period may be smaller than the duration of the voltage pulse which is essentially necessary to change the electrooptical material from one state to another.

A third feature of the present invention is such that the scanning electrodes and signal electrodes are provided for applying the desired voltage to the electrooptical material and the voltage is applied as waveforms as shown in FIGS. 7 and 8.

A fourth feature of the present invention lies in the driving of an electrooptical device according to the method as described above.

A fifth feature of the present invention lies in an electrooptical apparatus which employs the electrooptical device driven by the method as described above.

The electrooptical apparatus will now be described more specifically.

The electrooptical apparatus comprises one or more cells including an electrooptical material which assumes different optical states, depending upon the polarity of the voltage applied thereto and one or more electrode pairs for applying voltages to the electrooptical material, and driving circuits for applying voltages to the respective electrode pairs of the cells.

The present invention further provides a driving circuit suitable for driving the electrooptical device of the electrooptical apparatus.

The driving circuit comprises means for applying high-frequency AC voltages of substantially the same frequency and inverted phase to the electrode pairs which are to hold the present optical states, and means for applying high-frequency AC voltages of substantially the same frequency, phase and amplitude but having a difference corresponding to a DC bias voltage which can set the electrooptical material to a desired optical state, to the electrode pairs which are to set the electrooptical material to the desired optical state.

It suffices that the high-frequency AC voltage, employable in the present invention have a frequency high enough for the electrooptical material not to follow the changes in the direction of the electric field applied thereto. A variety of AC waveforms may be employed. While it is preferable that the frequency, phase, or amplitude be selected according to the conditions desired therefor, no strict accuracy is required.

As described above, the present invention primarily features a driving method in which a high-frequency AC voltage of a frequency too high for the electrooptical material to respond to the changes in the polarity of the voltage applied, is applied after application of a DC voltage pulse for setting the picture elements to a desired state during a selected period. This high-frequency AC voltage may be (1) a high-frequency AC voltage symmetrical with respect to negativity and positivity or 0 level, or (2) a high-frequency AC voltage superposed with a bias voltage, which always is in one polarity and applied only intermittently. Thus, possible changes in the states can be minimized, and high contrast is always maintained.

In the latter case where a bias voltage may be superposed on the high-frequency AC voltage, more remarkable advantage can be obtained by designing the electrooptical device so that it may be in a light cutoff state when a DC voltage of the polarity which is the same as that of the bias voltage is applied to the device.

As described above, the inventors of the present invention have found that the response to the previously applied DC voltage pulse is not always to be completed if the symmetrical high-frequency AC voltage is applied immediately after the application of the DC voltage pulse for setting the picture elements to a desired state. This phenomenon will now be described in detail with reference to FIG. 9.

As illustrated in FIG. 9(*a*), a DC voltage pulse 14 is applied to a ferroelectric liquid crystal 7 at 12*b*. Then, when the molecule 7 reaches at least a position 12*c*, where the response is not complete, a symmetrical high-frequency AC voltage 15 is applied immediately as shown in FIG. 9(*b*). If the ferroelectric liquid crystal molecule 7 has a negative dielectric anisotropy, a dielectric torque 16 by the AC voltage acts to put the liquid crystal molecule in a position perpendicular to a direction of the voltage applied as shown in FIG. 9(*b*). With reference to FIGS. 2 and 3, the liquid crystal molecule is placed in a position parallel with the glass plates 2. After that, the ferroelectric liquid crystal molecule 7 reaches a position 12*a* as shown in FIG. 9(*c*) to complete its response. If the high-frequency AC voltage 15 is applied continuously, the state is stabilized.

If high-frequency voltage pulses are applied both to the scanning electrode and to the signal electrodes and the high-frequency voltages applied to the scanning electrodes and the signal electrodes are out of phase by 180° as shown in FIG. 7(*a*) and (*b*), a high-frequency AC voltage corresponding to a sum $(V_1+V_2)$ of the voltage pulses applied to the electrodes, respectively, is applied to the electrooptical material held between the electrodes. In this case, the voltages to be applied to the respective electrodes can be substantially reduced.

Alternatively, the high-frequency voltage pulse to be applied to the signal electrode and the high-frequency voltage pulse to be applied to the scanning electrode during the selected period may be in phase with one another and have the same amplitude, but will differ by a DC bias voltage $V_{DC}$, as shown in FIGS. 8(*a*) and (*b*). In this case, a DC voltage pulse $V_{DC}$ as shown in FIG. 8(*c*) can be applied. This can be used for changing the state of the electrooptical material from one to another.

The driving method according to the present invention can attain both the task of high contrast and the task of low voltage driving. Therefore, an electrooptical device with a drive means of small size and of power-saving type can be realized. An electrooptical apparatus employing such an electooptical device can also be provided with great advantage.

BRIEF DESCRIPTION OF THE DRAWINGS

FIGS. 34 and 35 are tables explaining the logic operations of the optical logic elements, respectively;

DETAILED DESCRIPTION OF THE PREFERRED EMBODIMENTS

Preferred embodiments of the present invention will now be described with reference to the drawings.

Embodiment 1

Figure 10:
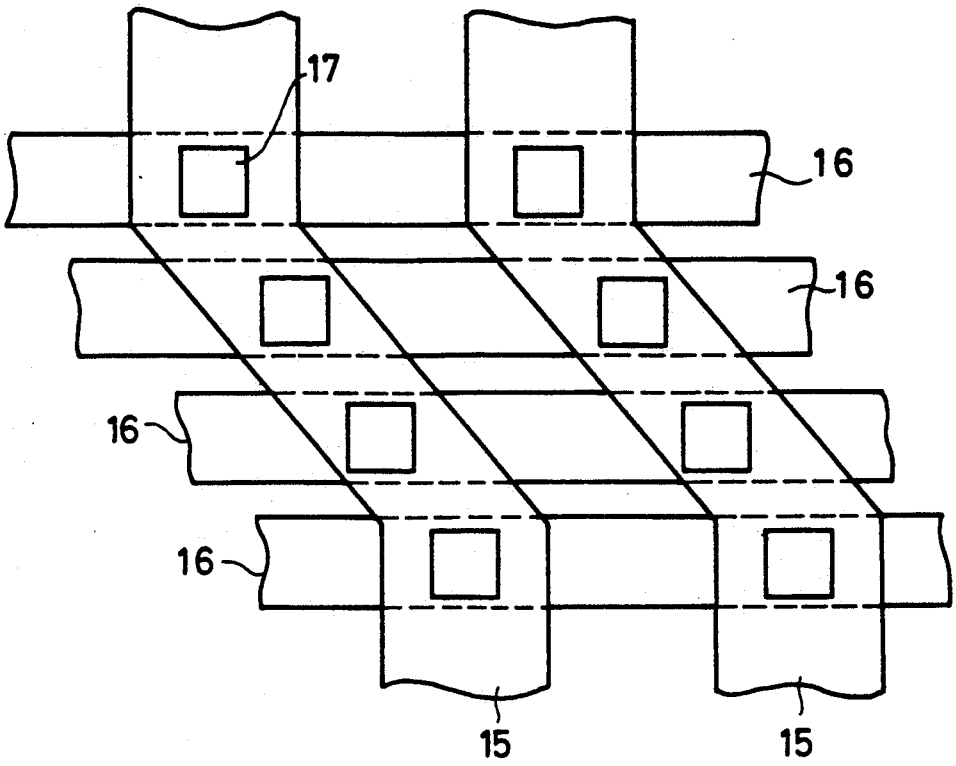
FIG. 10 is a plan view showing a configuration of one form of the electrooptical device according to the present invention.

Electrooptical materials preferably employable in the present invention include ferroelectric liquid crystal having a negative dielectric anisotropy. For example ferroelectric liquid crystal employed for the present invention can have a dielectric anisotropy $\Delta\epsilon$ of $-3$. FIG. 10 is a schematic view showing an electrode arrangement of an electrooptical device employing the ferroelectric liquid crystal which is to be driven by a driving method according to the present invention. The arrangement may function as a light switch array for a printer, for example.

The electrodes of the electrooptical device include a plurality of scanning electrodes 16 and a number of signal or data electrodes 15. Picture elements are provided at intersections of the scanning and signal electrodes. The picture elements 17 are made of transparent electrodes, and the remaining portions of the electrodes are made of chrome electrodes. A typical picture element is shown in section in FIG. 2. Two polarizers are used to constitute a birefringent type liquid crystal device. The ferroelectric liquid crystal device 36 (FIG. 11) is driven by drive means shown in FIG. 11. The drive means consists of a scanning electrode driving circuit 18 and a signal electrode driving circuit 19.

Figure 1:
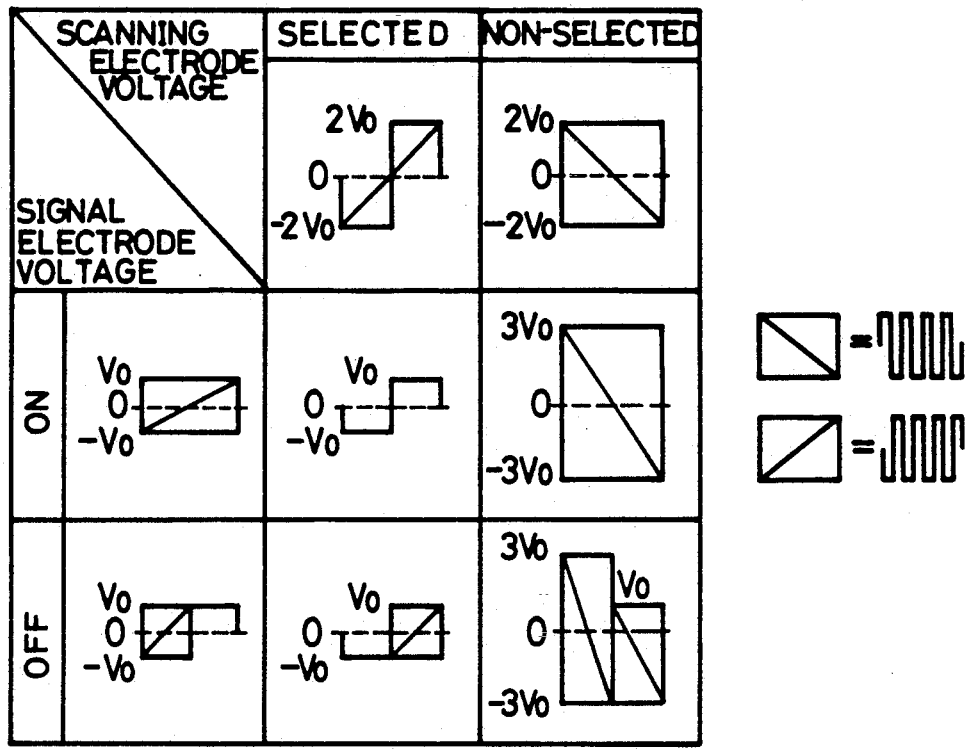
FIG. 1 is an explanatory view showing a set of drive voltage waveforms employable for a first mode of driving method according to the present invention.

Driving waveforms employable for the driving method according to the present invention are exemplarily shown in FIG. 1.

The driving waveforms shown in FIG. 1 are formed of the combination of a first and a second high-frequency AC voltage which are $\pi$ out of phase from each other and of two DC voltage pulses of opposite polarities. It is not necessary for the voltage to be exactly opposite in phase to be accurately. The second high-frequency AC voltage has an amplitude twice that of the first high-frequency AC voltage. The ratio of the amplitudes is not critical, and need be not exactly twice.

The first and the second high-frequency AC voltages are preferably of repetitive rectangular pulses, but they are not limited to such pulses. The DC voltages may also preferably be of rectangular pulses, but they are not limited to such pulses either. In the embodiment as illustrated, rectangular waveforms are employed for both the AC and the DC voltages.

The "high-frequency" used here means such a frequency which is high enough to impart the ferroelectric liquid crystal of an electrooptical material with an AC stabilization effect, without causing any change in the responsive state of the ferroelectric liquid crystal.

Each of the scanning electrodes 16 has two operational modes consisting of a selected or addressed mode and a non-selected or non-addressed mode. Similarly, the signal electrode 15 has two operational modes such as an ON-mode and an OFF-mode. These are combined to provide four patterns of driving waveforms shown in FIG. 1.

During the selected or addressed period for the scanning electrode 16, the first high-frequency voltage is superposed with a DC voltage pulse which changes in polarities from a first half of the selected period to a latter half of the period. The thus superposed voltage is applied to the scanning electrode. More specifically, a high-frequency AC voltage (pulse height: $-2V_0$) of a negative polarity is applied during the first half of the period and a high-frequency AC voltage (pulse height: $2V_0$) is applied during the latter half of the period.

During the non-selected or non-addressed period for the scanning electrode, the second high-frequency AC voltage (amplitude: $2V_0$) is applied.

When the signal electrode 15 is required to be turned on, the first high-frequency AC voltage (amplitude: $V_0$) is applied. When the signal electrode 15 is to be turned OFF, the first high-frequency AC voltage (amplitude: $V_0$) is applied during a first half of an OFF-signal applying period, and a positive DC voltage having a pulse level of $V_0$ is applied during a latter half of the period.

When the voltages of those waveforms are applied in a desired combination to the electrodes 15 and 16, the associated picture elements may be applied with the following four voltage patterns, respectively:

(1) For the picture element whose signal electrode 15 is turned on during the selected period of the associated scanning electrode 16, AC components are cancelled and a negative DC voltage having a pulse height of $-V_0$ is applied during the first half of the selected period and a positive DC voltage having a pulse height of $V_0$ is applied during the latter half of the period.

(2) For the picture element whose signal electrode is turned off during the selected period for the associated scanning electrode 16, AC components are cancelled and a DC voltage having a pulse height of $-V_0$ is applied during the first half of the period, DC components are cancelled and the first high-frequency AC voltage having an amplitude of $V_0$ is applied during the latter half of the period.

(3) For the picture element whose signal electrode 15 is turned on during the non-selected period for the associated scanning electrode 16, the first and the second high-frequency AC voltage, which are opposite in phase, are added and a high-frequency AC voltage having an amplitude of $3V_0$ is applied.

(4) For the picture element whose signal electrode 15 is turned off during the non-selected period for the associated scanning electrode, a high-frequency AC voltage having an amplitude of $3V_0$ is applied during the first half of the period as in (3) above, and a voltage, which corresponds to the second high-frequency AC voltage (amplitude: $2V_0$) whose level is shifted in a negative direction by a DC voltage $V_0$, is applied during the latter half of the period.

With this arrangement, the scanning electrodes are always applied with high-frequency pulse voltages, while the signal electrodes 15 are applied with a voltage consisting of high-frequency voltage pulses and DC voltage pulses. The ferroelectric liquid crystal is applied mostly with a high-frequency AC voltage having an amplitude of $+3_0$ which is larger than that of the high-frequency AC voltage pulses applied to both the electrodes. Only when an OFF-signal is applied to the signal electrode, a bias voltage of $-V_0$ is applied. Therefore, at least OFF-states are substantially perfectly maintained. This assures high contrast.

Figures 12, 13:
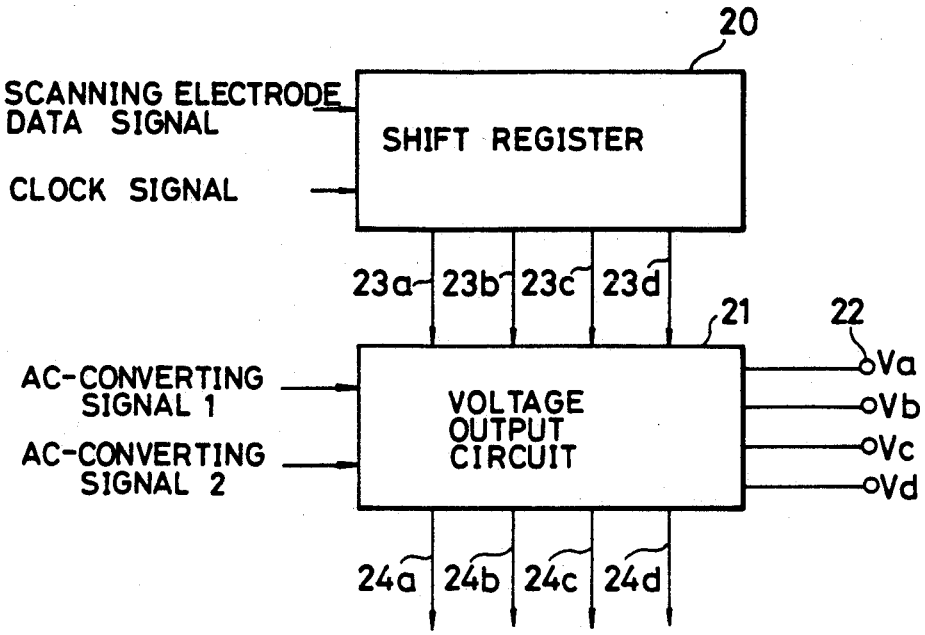
FIG. 12 is a block diagram showing one form of scanning electrode driving circuit.
FIG. 13 is a table for setting output voltage patterns for the scanning electrode driving circuit.

The scanning electrode driving circuit 18 used for producing the driving waveforms comprises a shift register 20 and a voltage output circuit 21, as specifically shown in FIG. 12.

The shift register 20 is of a serial input/parallel output type, and has output terminals for outputting selection control signals (1–4) 23a–23d corresponding to the respective scanning electrodes 16. The register 20 takes in a scanning electrode data signal in response to a clock signal applied and sequentially shifts the taken-in data.

The voltage output circuit 21 selects one of four voltages Va, Vb, Vc and Vd applied to an output voltage supplying terminal 22 according to the values of the selection control signals 23a, 23b, 23c and 23d from the shift register 20 and the values of an AC-converting signal 1 and an AC-converting signal 2, as shown in FIG. 13, to output an output voltage 24. The voltage output circuit 21 having these features can be realized by a configuration such as illustrated in FIG. 28.

Figure 28:
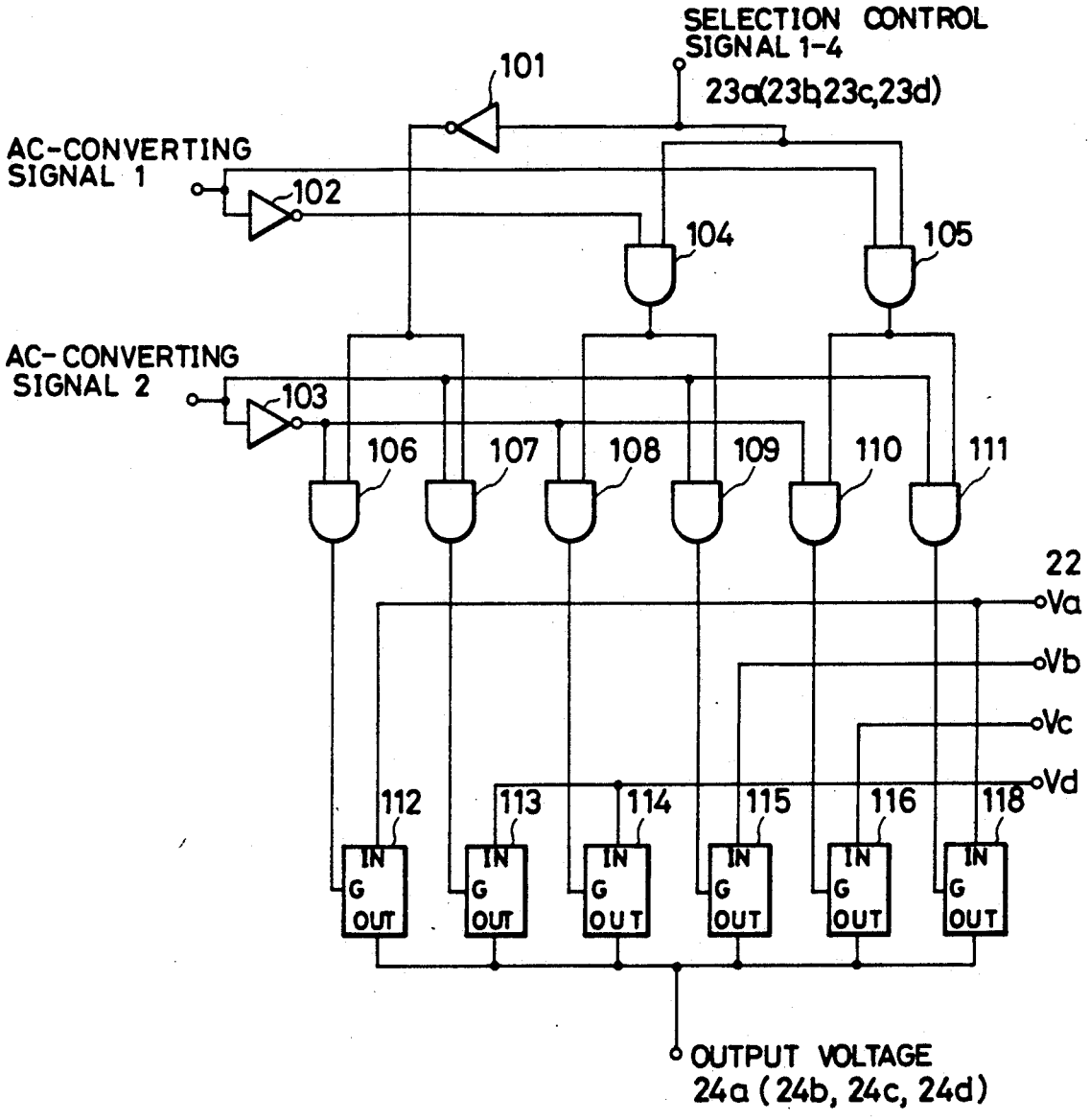
FIG. 28 is a logic circuit diagram of one form of a voltage output circuit in the scanning electrode driving circuit, showing one system thereof.

While the circuit of FIG. 28 is provided for each of the selection control signals (1–4) 23a–23d, only the circuit for the selection signal 23a and the output voltage 24a is illustrated in FIG. 28.

The selection control signal 23a is supplied to an inverter 101, an AND gates 104 and 105. The AND gate 105 has another input for receiving the AC-converting signal 1. Similarly, the AND gate 104 has another input for receiving the AC-converting signal 1 through an inverter 102. An output from the inverter 101 is inputted to an AND gate 106 and an AND gate 107. An output from the AND gate 104 is inputted to an AND gate 108 and an AND gate 109, while an output from the AND gate 105 is inputted to an AND gate 110 and an AND gate 111.

The AND gates 106, 108 and 110 are further inputted with the AC-converting signal 2 through an inverter 103. The AND gates 107, 109 and 111 further receive the AC-converting signal 2 directly. Outputs from the AND gates 106–111 are supplied to gate terminals of corresponding analog switches 112–118, respectively.

The analog switches 112 and 118 have input terminals supplied with the output voltage Va from the output voltage supplying terminal 22. An input terminal of the analog switches 113 and 114 is supplied with the output voltage Vd of the output voltage supplying terminal 22. Similarly, an input terminal of the analog switch 115 is supplied with Vb from the output voltage supplying terminal 22, and an input terminal of the analog switch 116 is supplied with Vc from the output voltage supplying terminal 22. Outputs from the analog switches 112–118 are generated in the form of output voltage 24a.

The analog switches 112–118 may be formed, for example, of MOS transistors.

The signal electrode driving circuit 19 comprises shift register 25, a latch circuit 26 and a voltage output circuit 27.

The shift register 25 is formed of a serial input/parallel output register which serially takes in a signal electrode data signal in response to a clock signal and outputs in parallel to output terminals corresponding to the respective signal electrodes 15.

The latch circuit 26 is of a parallel input/serial output configuration. It takes in the outputs from the register 25 to hold them temporarily provides an output which is the same as data signals 28.

Figures 15, 16:
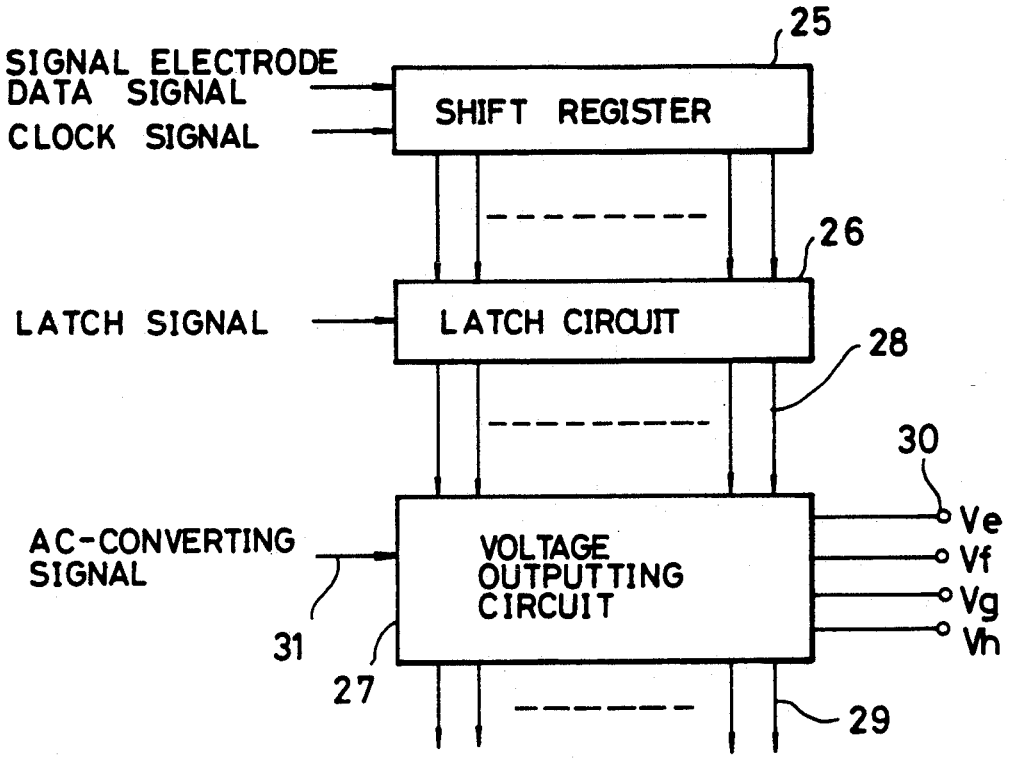
FIG. 15 is a block diagram showing one form of signal electrode driving circuit.
FIG. 16 is a table for setting output voltage patterns for the signal electrode driving circuit.

The voltage output circuit 27 selects one from four voltages Ve, Vf, Vg and Vh applied to the output voltage supplying terminal as shown in FIG. 16, according to the values of the data signals 28 from the latch circuit 26 and the value of an AC-converting signal 31, to generate output voltages 29. This voltage output circuit 27 may be realized, for example, by a configuration as shown in FIG. 29.

Figure 29:
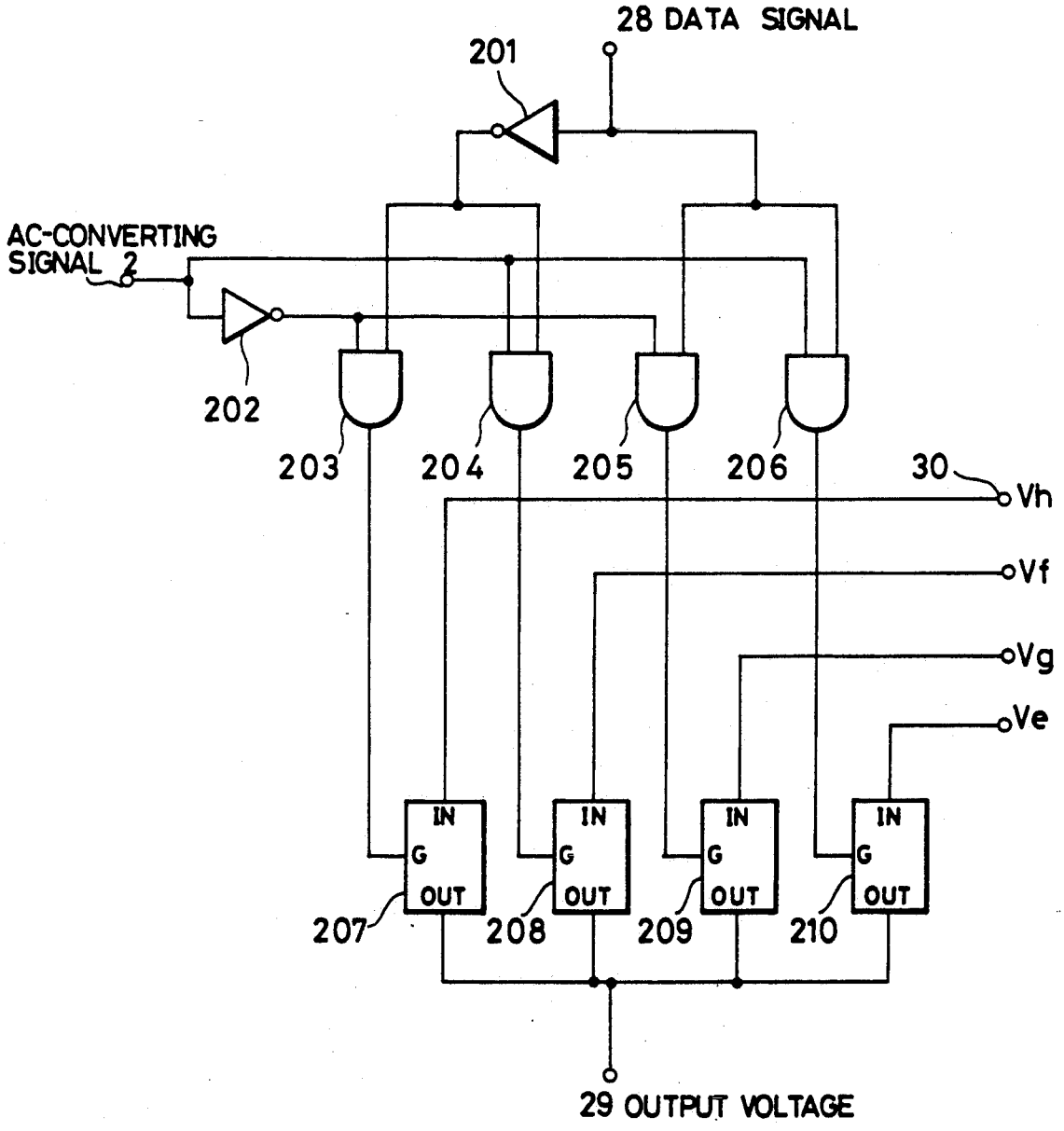
FIG. 29 is a logic circuit diagram of one form of a voltage output circuit in the signal electrode driving circuit, showing one system thereof.

A similar circuit to that of FIG. 29 is provided for each of the data signals 28. In FIG. 29, a single circuit is exemplarily shown for one data signal.

The data signal 28 is inputted to an inverter 201 and AND gates 205 and 206. An output from the inverter 201 is inputted to AND gates 203 and 204. The AND gates 204 and 206 further receive the AC-converting signal 1 directly. On the other hand, the AND gates 203 and 205 are further inputted with the AC-converting signal 1 through an inverter 202. Outputs from the AND gates 203–206 are inputted to gates of corresponding analog switches 207–210, respectively. Input terminals of the respective analog switches 207–210 are inputted with the output voltages Vh–Ve from an output voltage supplying terminal 30, respectively. Outputs from the analog switches 207–210 are generated in the form of output voltages 29. The analog switches 207–210 are formed, for example, of MOS transistors.

An operation of the present embodiment will now be given.

First, the operation when the scanning electrodes 16 are driven by the scanning electrode driving circuit 18 is described.

A cyclic, scanning electrode data signal is inputted to the shift register 20, and a clock signal is further inputted simultaneously for taking in the scanning electrode data signals, at a falling of the clock signal as can be seen from FIG. 13. The so taken-in data are sequentially shifted at the timing of the clock signal. As a result of this, the scanning electrode data signals appear sequentially in the form of selection control signals 1 to 4 (23a to 23d).

Each of the selection control signals 23a to 23d from the shift register 20 is used as a gate signal to selectively output the AC-converting signal 1 and/or the AC-converting signal 2. The AC-converting signals are used in turn as gate signals to selectively AC-convert the voltages Va to Vd supplied to the respective terminals of the output voltage supplying terminal 22 for generating the output voltages 24a to 24d. The output voltages 24a to 24d are obtained by combination of the AC-converting signals 1 and 2 with the output voltages Va to Vd as shown in FIG. 13.

Figure 14:
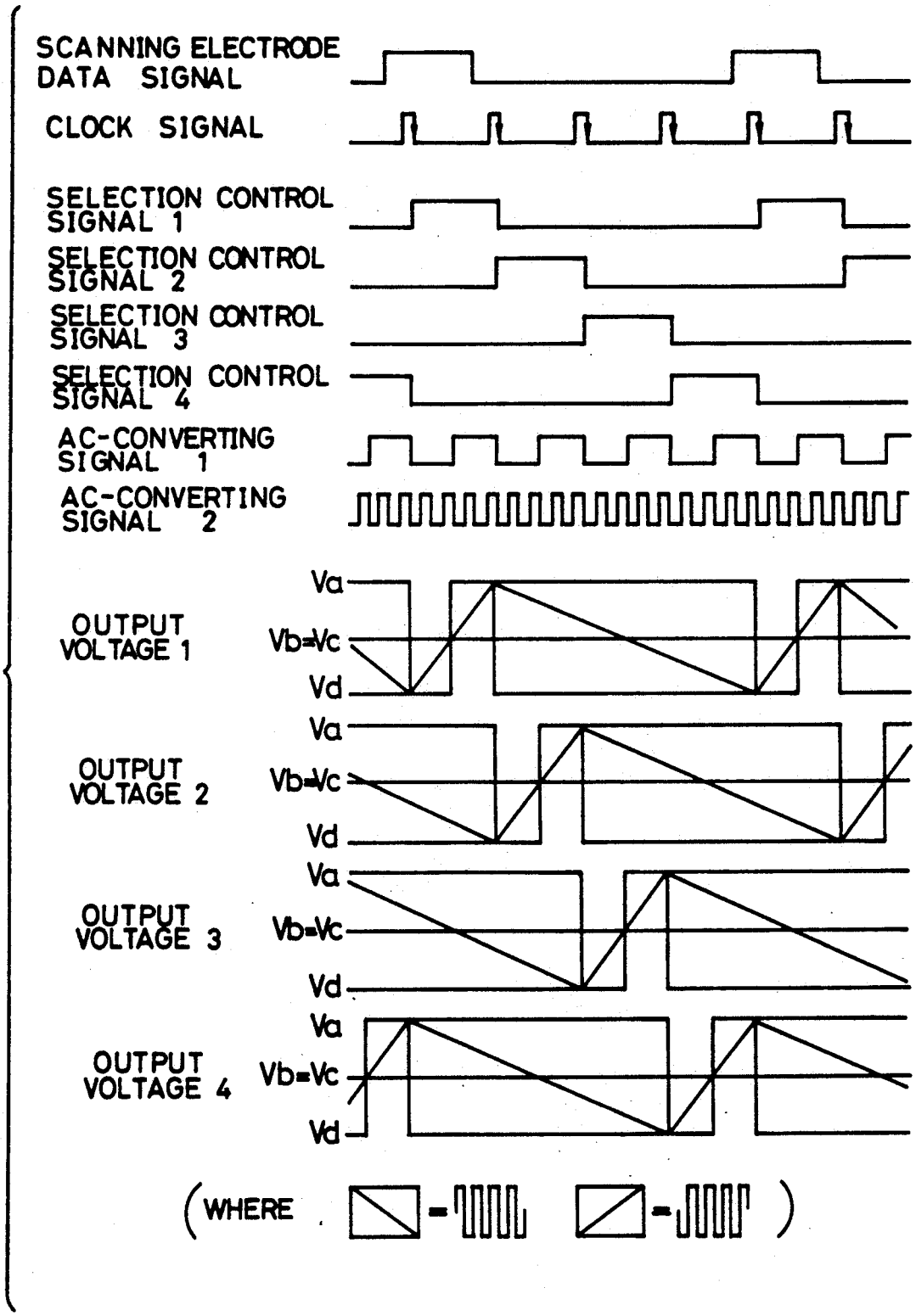
FIG. 14 is a timing chart showing an operation of the scanning electrode driving circuit.

Voltages Va of $2V_0$, Vb=Vc of 0 and Vd of $-2V_0$ are applied to the four terminals of the output voltage supplying terminal 22, and various signals as shown in the timing chart of FIG. 14 for the scanning electrode driving circuit are supplied. The resultant voltages to be applied to the scanning electrodes are as shown in FIG. 1.

In this connection, it is to be noted that the first high-frequency AC voltage and the second high-frequency AC voltage are formed by inverting the AC-converting signal 2 by the inverter 103 to differentiate the phases. The waveforms during the selected period for the scanning electrode are formed by using the AC-converting signal 1.

An operation for driving the signal electrodes 15 by the signal electrode driving circuit 19 will now be described.

The signal electrode data are taken in the shift register 25 in response to the clock signal, and the data are shifted sequentially. After the data for all the signal electrodes 15 have been taken in, all the data in the shift register are taken, in parallel, into the latch circuit 26.

The data signals 28 from the latch circuit 26 are combined with the AC-converting signal 2 by the voltage output circuit 27 to convert the voltages Ve to Vh from the output voltage supplying terminal 30 into AC voltages or DC pulses.

Figure 17A:
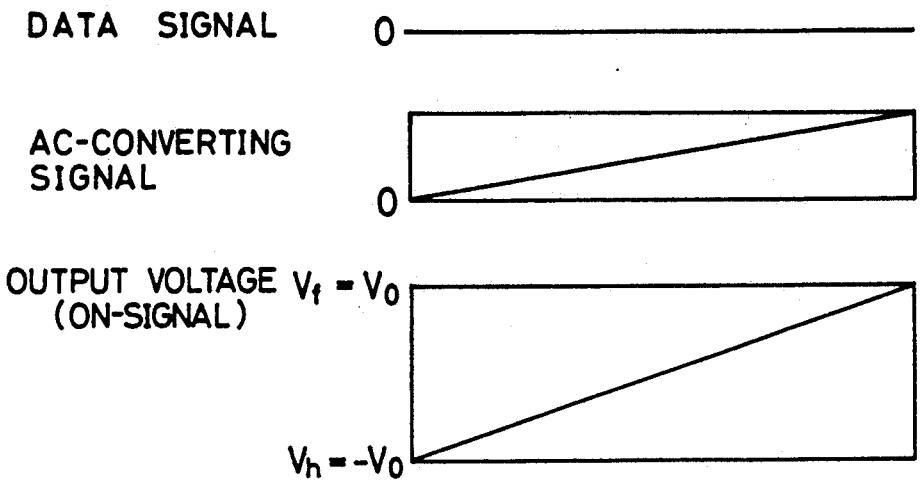
FIGS. 17(*a*)–17(*b*) are waveform diagram showing an operation of the signal electrode driving circuit.
Figure 17B:
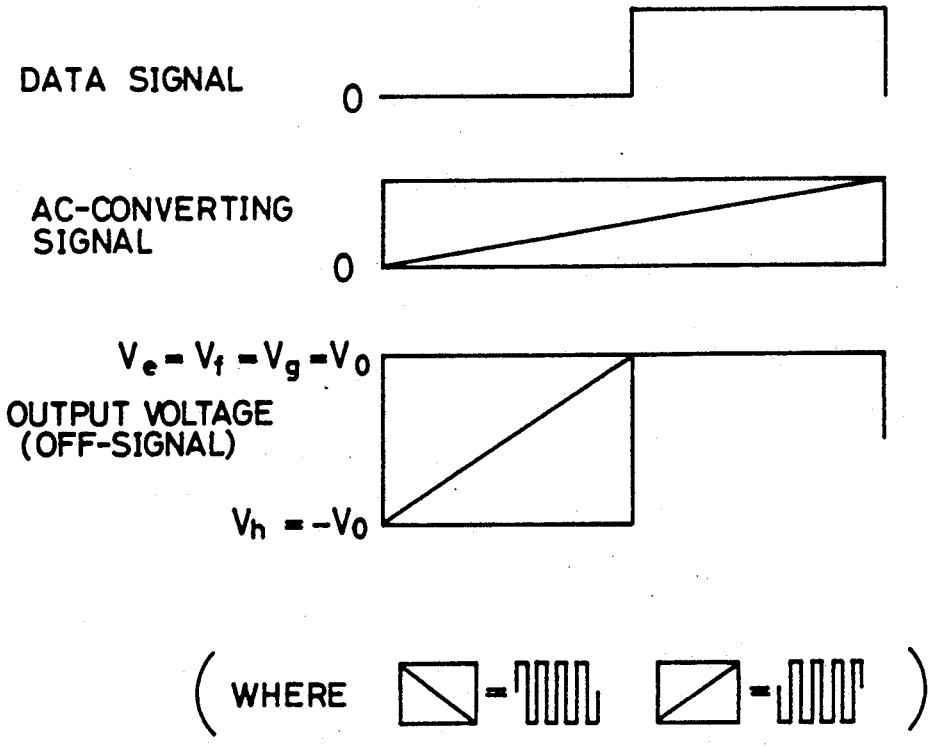
Figure 18:
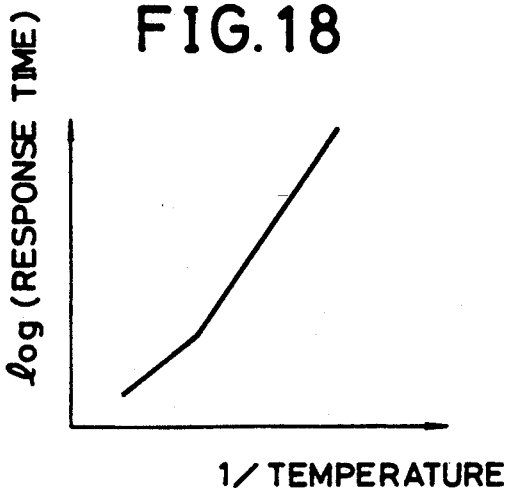
FIG. 18 is a diagram showing a temperature characteristic of ferroelectric liquid crystal.

With this arrangement, it will be seen that when the voltages $Ve=Vf=Vg=V_0$ and $Vh=-V_0$ are applied to the four terminals of the output voltage supplying terminal 30, and data signal 28 for an ON-signal shown in FIG. 17(*a*) or a data signal 28 for an OFF-signal shown in FIG. 17(*b*) and a certain AC-converting signal 31 are applied, voltages to be applied to the signal electrodes as shown in FIG. 1 are obtained.

The analog switches 207 and 208 generate voltages Vh and Vf of different polarities alternately, in response to an AC-converting signal inverted in phase by the inverter 202 and the non-inverted AC-converting signal 2 which are applied alternately as gate signals when a data signal is "0". As a result of this, AC output voltages as shown in FIG. 17(*a*) and FIG. 17(*b*) are obtained. On the other hand, the analog switches 209 and 210 generate voltages Vg and Ve of the same polarity alternately in response to gate signals in the form of an AC-converting signal inverted in phase by the inverter 202 and the noninverted AC-converting signal which are applied alternately when the data signal is "1". Thus, a DC output voltage as shown in FIG. 17(*b*) is obtained.

The thus obtained voltages to be applied to the scanning electrode and the signal electrode are combined to provide various driving waveforms such as shown in FIG. 1. Each of the picture elements is responsive to the waveforms to change or hold its state. Voltages other than those as mentioned above may be applied to the output voltage supplying terminals for both the electrode driving circuits to vary the driving waveforms of FIG. 1.

When the multiplexed driving is carried out, using the driving waveforms shown in FIG. 1 and under such conditions that the number of time divisions for multiplexed driving is 4, one scanning period is 1.2 ms long, one selected period is 0.3 ms long, a liquid crystal layer is 5 μm thick and a high-frequency AC voltage to be applied has a frequency of 20 to 25 KHz. Contrast as high as 30 or more is obtained with the voltage $V_0$ of 10 to 15V While +10V of the DC voltage pulses $+V_0$ applied during the selected period are not sufficient, alone, to change the optical state of the liquid crystal, but the liquid crystal becomes fully responsive to change its optical state during the succeeding application of the high-frequency AC voltage of zero bias voltage. However, the DC voltage pulse to be applied to the liquid crystal during the selected period, itself, may be sufficient to change the optical state of the liquid crystal, in any of the embodiments given in this specification. If the high-frequency AC voltage is applied after the application of such a DC voltage pulse, the optical state changed by the pulse can more surely be held.

In the known driving method, a DC voltage of an undesired polarity may be applied after the application of the desired DC voltage pulse. In contrast, the present invention is free from undesired application of the DC voltage of adverse polarity before the stabilization effect by the high-frequency AC voltage has been exerted.

Since the high-frequency AC voltage is always applied during the non-selected period according to the present invention, the AC stabilization effect as mentioned above can necessarily be obtained. Especially, according to the embodiment 1, the high-frequency AC voltage is applied directly after the DC pulse which sets the optical state of the picture element, whether it is an ON-state or an OFF-state. This assures more positive AC stabilization.

Throughout the embodiments as described here, the first and the latter half of the selected period may be preferably of an equal length. They may, however, also be of different lengths is desired.

The frequency of the high-frequency AC voltage employable in the embodiments of the present invention is not limited to that as exemplarily shown before, and it may be selected according to the configuration of the cell constituting each picture element, or the kind of the electrooptical material.

Improvement of a temperature characteristic is made, for example, as follows:

A time required for response to a change in the direction of an electric field applied to a ferroelectric liquid crystal depends largely on a temperature. The time will be shorter as a temperature rises within a temperature range in which the ferroelectric liquid crystal shows the ferroelectricity. For this reason, when the temperature of the device rises, the device may be so sensitive as to respond to every pulse of the high-frequency AC voltage. Or, when the temperature of the device is too low, the device may possibly be non-responsive to the DC voltage pulse applied during the selected period.

Figure 19:
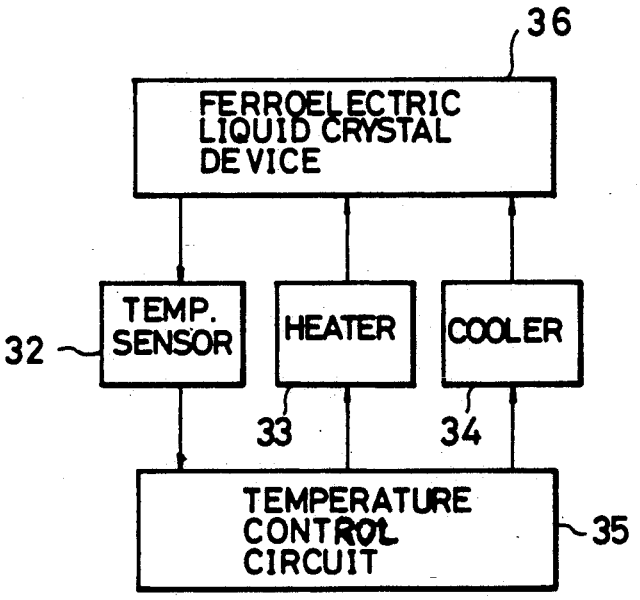
FIG. 19 is a block diagram showing one form of an apparatus for effecting temperature compensation for ferroelectric liquid crystal.

It may be proposed to keep the temperature of the ferroelectric liquid crystal device 36 constant throughout the driving so that the ferroelectric liquid crystal may develop a desired uniform electrooptical effect. This proposal can be realized by an apparatus as illustrated in FIG. 19. The apparatus comprises a temperature sensor 32 for the ferroelectric liquid crystal device and a temperature control circuit 35 for controlling a heater 33 or a cooler 34 in response to a signal from the temperature sensor 32. There is another proposal for obtaining a similar effect, in which the level of the driving voltage is changed or the duration of the voltage pulse is varied according to the temperature of the ferroelectric liquid crystal device 36.

The ferroelectric liquid crystal employed in the present embodiment has a dielectric anisotropy of $\Delta\epsilon=-3$. A dielectric torque caused during the application of the high-frequency AC voltage becomes larger as the value of the dielectic anisotropy increases. The inventors of the present invention, however, have found that the larger dielectric anisotropy the ferroelectric liquid crystal has, the slower the ferroelectric liquid crystal respond to the direction of the electric field applied. In view of these phenomena, a value of the dielectric anisotropy $\Delta\epsilon$ of from $-4$ to $-2$ may be preferably employed for obtaining good driving characteristics.

The driving waveforms suited for the first to third features of the driving method according to the present invention are not limited to those shown in FIG. 1. Waveforms shown in FIGS. 21, 22 and 23 are also preferably employed for the driving method according to the present invention.

Figure 21:
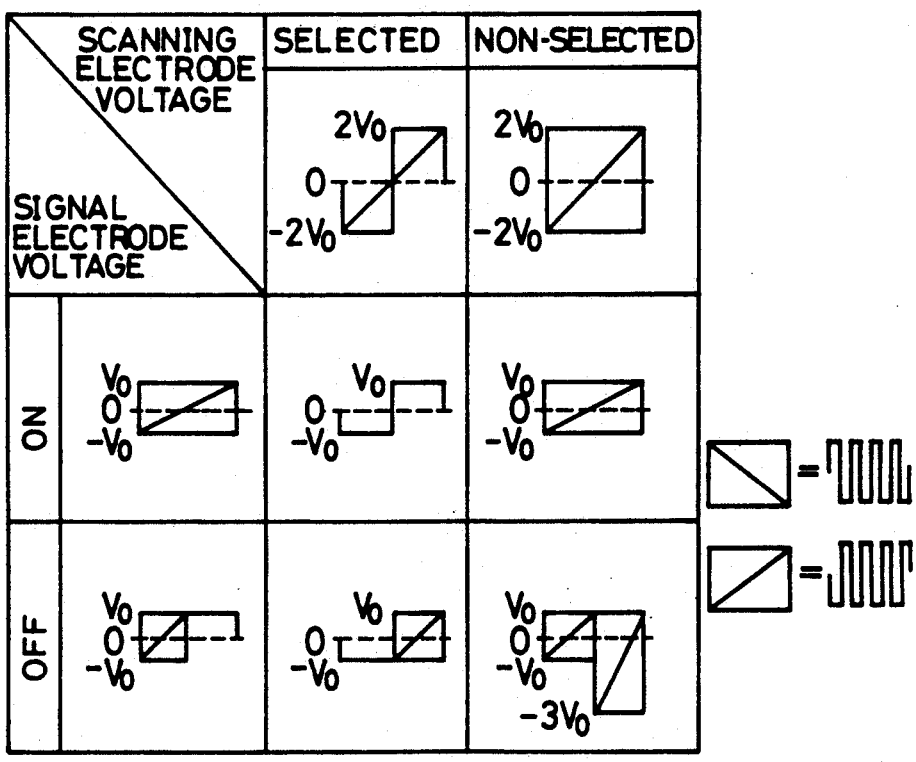
FIGS. 21, 22 and 23 are explanatory views each showing drive waveforms for modification of the first mode of the driving method.

In the driving waveforms of FIG. 21, the high-frequency voltage pulses applied to the scanning electrodes and the signal electrodes are all in phase with each other.

Figure 22:
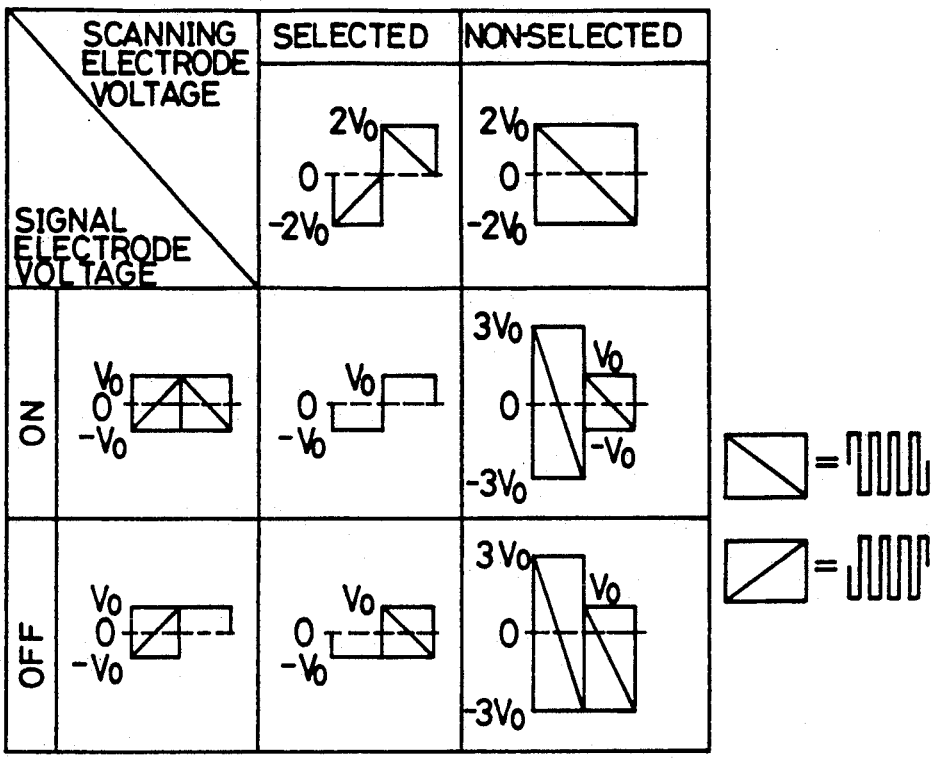

The driving waveforms of FIG. 22 are such that the voltage applied to the scanning electrodes during the selected period and the voltage applied to the signal electrodes for setting an ON-state are of opposite polarities from the first half of the selected period to the latter half thereof.

Figure 23:
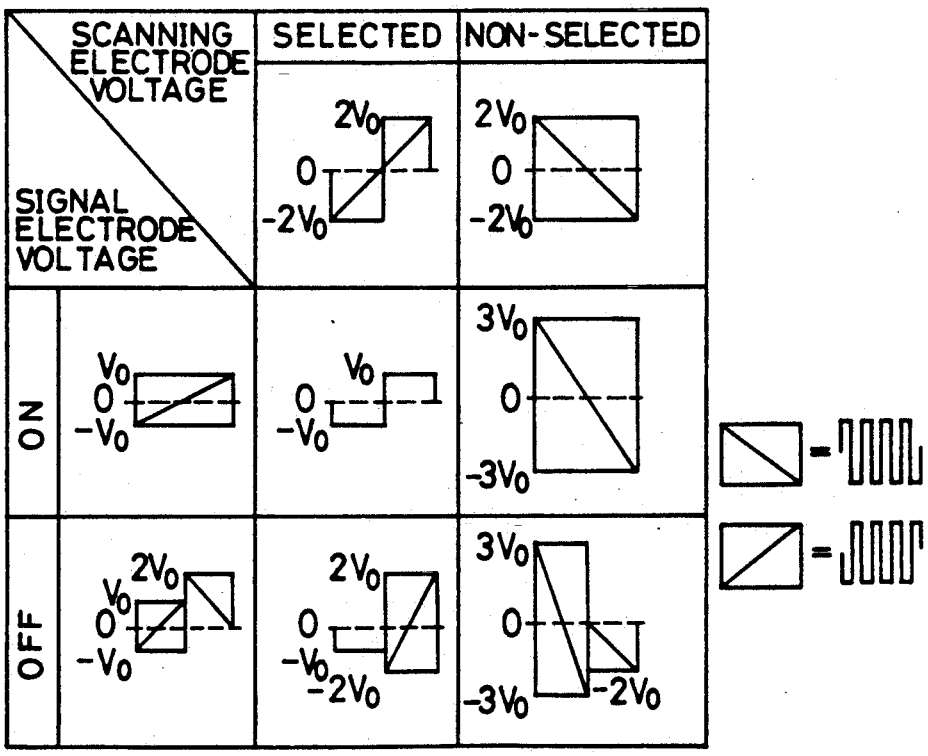

In the driving waveforms of FIG. 23, the voltage applied to the signal electrodes for setting an OFF-state includes four voltage levels. During the latter half of the selected period, a high-frequency AC voltage of $+2V_0$ which is higher than those of FIGS. 1, 21 and 22 is applied. This promotes the response of the picture element to the voltage $-V_0$ applied thereto.

Embodiment 2

Figure 24:
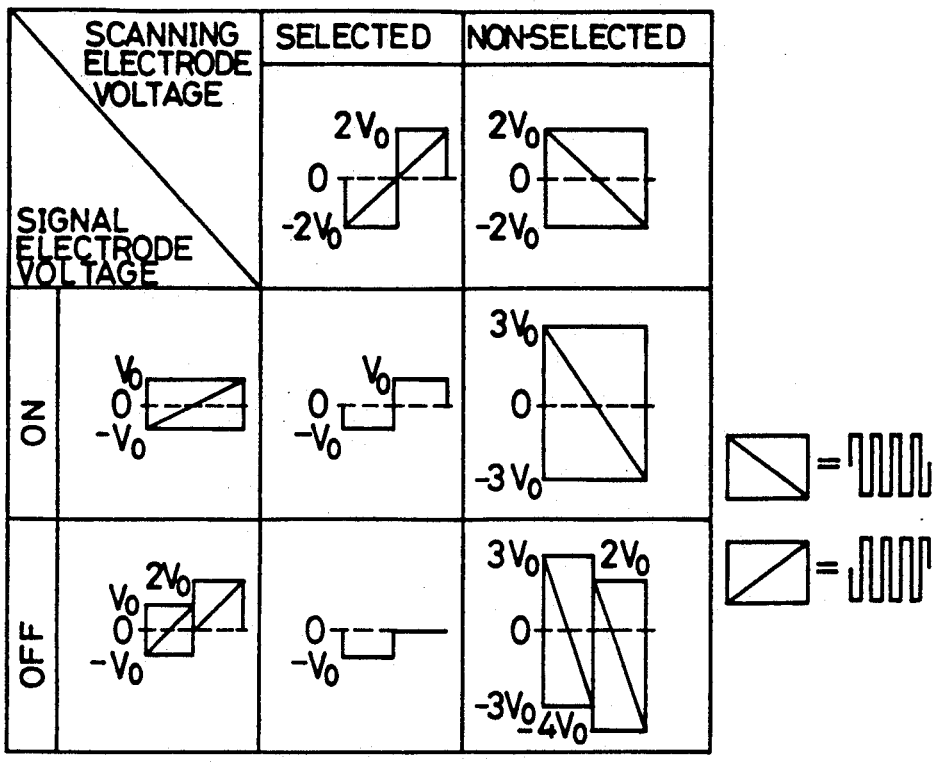
FIGS. 24 to 27 are similar explanatory views showing waveforms for second to fifth modes of the driving method according to the present invention.

A further set of the driving waveforms for enabling the driving method according the first to third features of the present invention includes waveforms as shown in FIG. 24. In this connection, it is to be noted that in this embodiment 2, and in embodiments 3 to 5 as will be given hereafter, the electrooptical device to be driven is substantially the same as that of the embodiment 1. The driving system is also substantially the same as that of the embodiment 1. Further, the mechanism as to how the waveforms are formed is similar to that of the embodiment 1. For this reason, only a characteristic feature of the waveforms will be given below. For the remaining matters, reference is to be made to the description for the embodiment 1.

In the present embodiment, the waveform of the voltage applied to the signal electrode during the OFF-time is different from that of FIG. 1. The remaining waveforms are similar to those shown in FIG. 1. Only the difference will be described.

The voltage to be applied to the signal electrode during the OFF-time is such that the waveform during the first half of the period is of a high-frequency AC voltage having an amplitude of $V_0$ as in FIG. 1. On the other hand, the high-frequency AC voltage in the first half is superposed with a DC voltage pulse of $+V_0$ as a bias during the latter half of the period. As a result of this, a waveform in which the high-frequency AC voltage is shifted toward the positive side is obtained. This waveform assures that a high-frequency voltage pulse will always be applied to all the electrodes.

While the voltage applied to the signal electrode during the ON-time is similar to that of the embodiment 1, the voltage applied thereto during the OFF-time is different. More particularly, the voltage applied to the scanning electrode 16 and the voltage applied to the signal electrode 15 cancel their AC components from each other to provide a DC voltage pulse during the first half of the OFF-time. The voltage applied to the scanning electrode 16 and the voltage applied to the signal electrode are in phase and of the same polarity during the latter half. As a result of this, the DC components are also cancelled from each other to make the voltage to be applied to the picture element zero.

On the other hand, the waveform during the first half of the non-selected period at the OFF-time is similar to that of the first half of the non-selected period at the OFF-time shown in FIG. 1. The waveform during the latter half is superposed with a DC voltage to shift by $V_0$ towards the negative side. Therefore, the high-frequency AC voltage applied during the non-selected period has an amplitude as large as $3V_0$, assuring high contrast.

Embodiment 3

Figure 25:
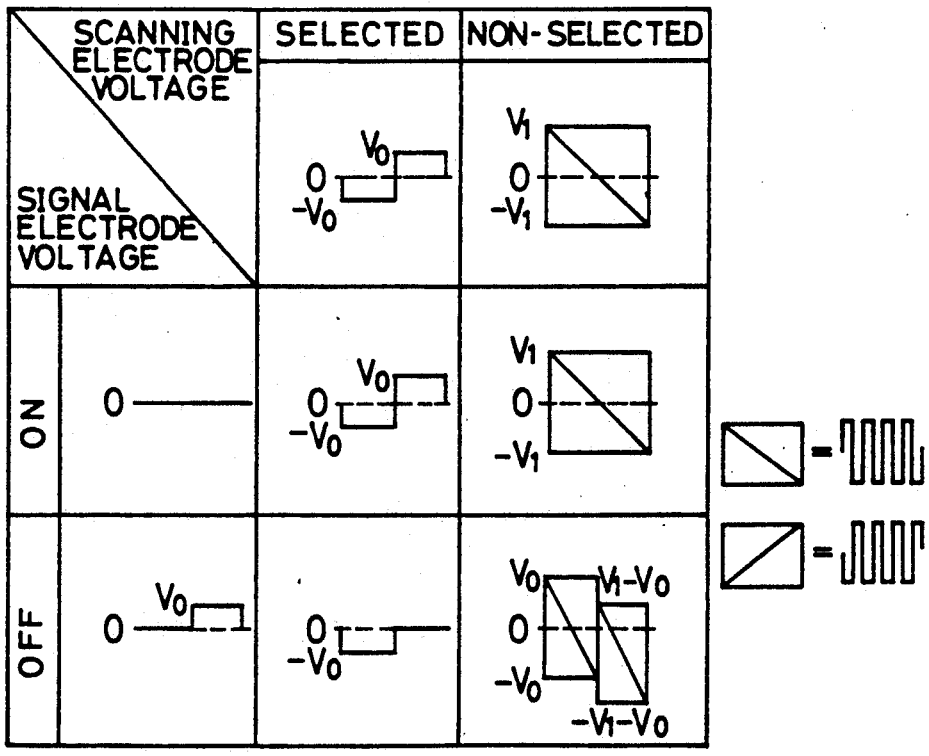

Another set of waveforms for enabling the driving method according to the first feature of the present invention is shown, for example, in FIG. 25. The level of the high-frequency AC voltage applied to the picture element during the non-selected period is equal to the level of the voltage applied to the scanning electrode.

Embodiment 4

Figure 26:
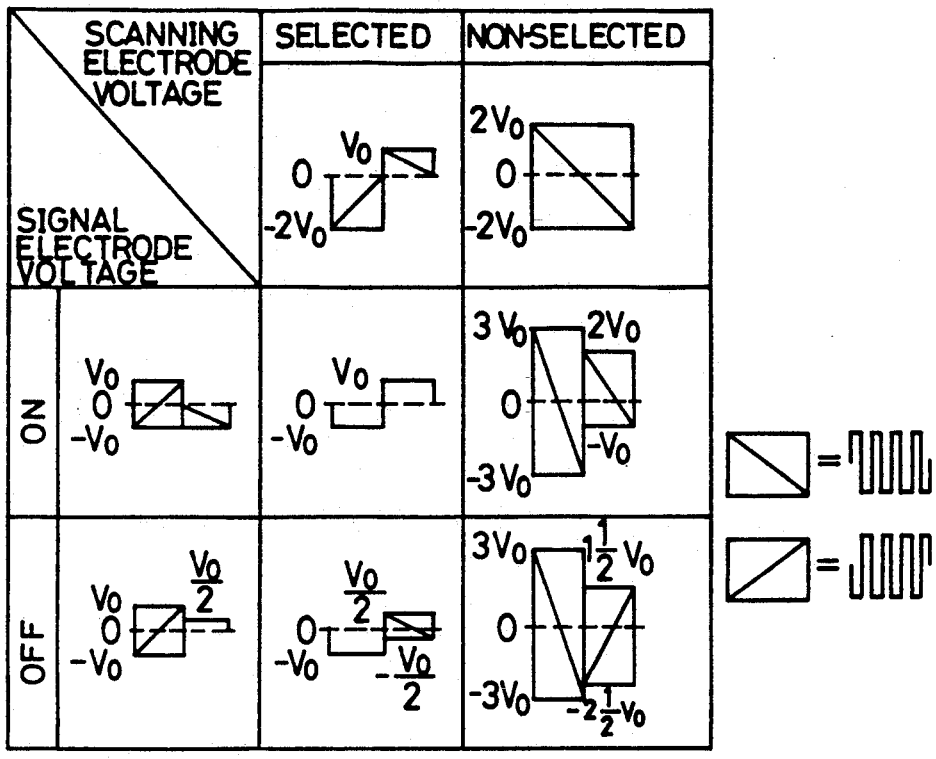

Similarly, FIG. 26 shows a further set of waveforms for carrying out the driving method according to the second feature of the present invention. Biases of $+(\frac{1}{2})V_0$ and $-(\frac{1}{2})V_0$ are superposed intermittently on the high-frequency AC voltage during the non-selected period.

Embodiment 5

Figure 27:
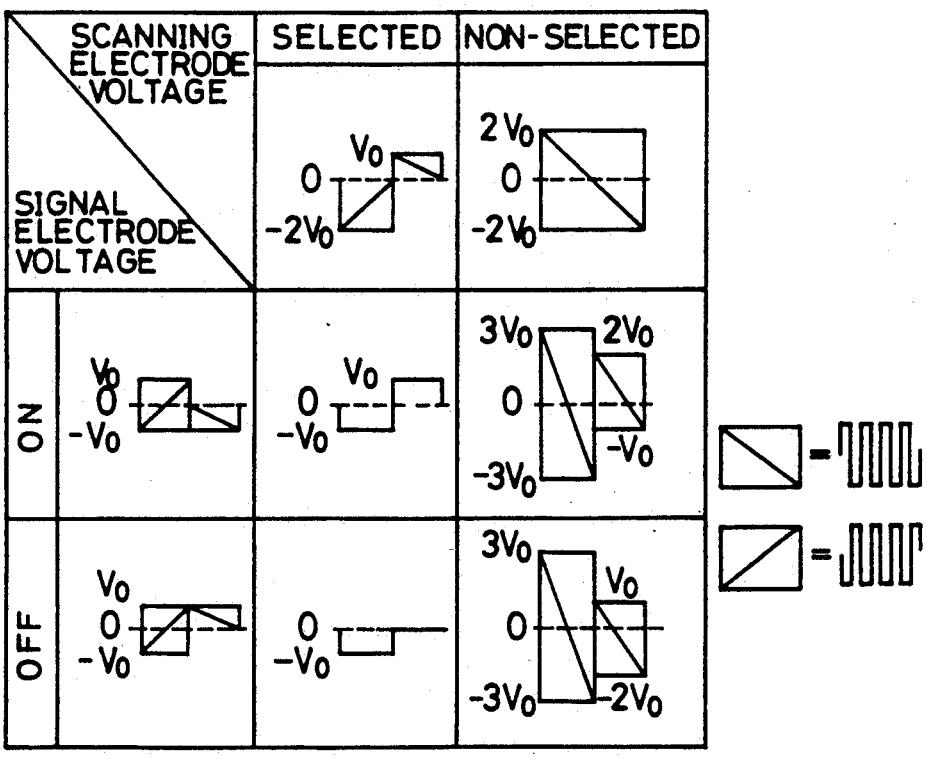

A further set of waveforms for carrying out the driving method according to the third feature of the present invention is shown in FIG. 27. A high-frequency voltage pulse is always applied to all the electrodes.

Although the ferroelectric liquid crystal is used as an electrooptical material to be driven by the method according to the present invention in the foregoing embodiments, the present invention is not limited to this material. The present invention is operative with any material which is capable of changing its optical state according to the direction of an electric field applied thereto while holding its previously set optical state when a high-frequency AC voltage is applied.

The high-frequency AC voltage heretofore referred to is not always required to be of uniform frequency throughout the operation time of the electrooptical device.

The foregoing description is made with reference to the application to the light switch array for a printer which is given exemplarily. The present invention, however, is not limited to this application and it may further be applied to a display when the light switch array is used as a display element. The light switch array may further be used for an exposure control apparatus to provide an optical printer. Or, an optical logic elements may also be provided.

The applications of the present invention will now be described in detail.

First, a printer in which the light switch array comprising the ferroelectric liquid crystal devices will be described.

Figure 20:
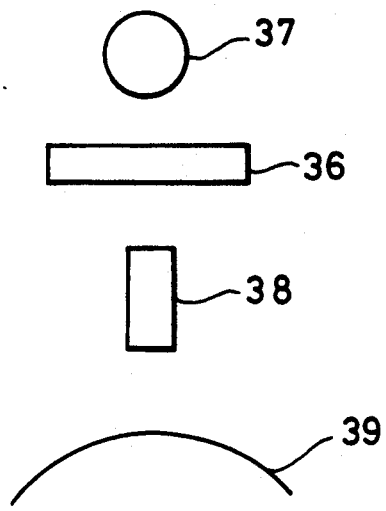
FIG. 20 is a diagrammatic view showing one form of an optical printer to which the light switch array or the driving method of the present invention is applied.

FIG. 20 illustrates a general formation of an electrophotographic printer which comprises an exposure apparatus which controls light transmission by the light switch array through picture elements.

Figure 11:
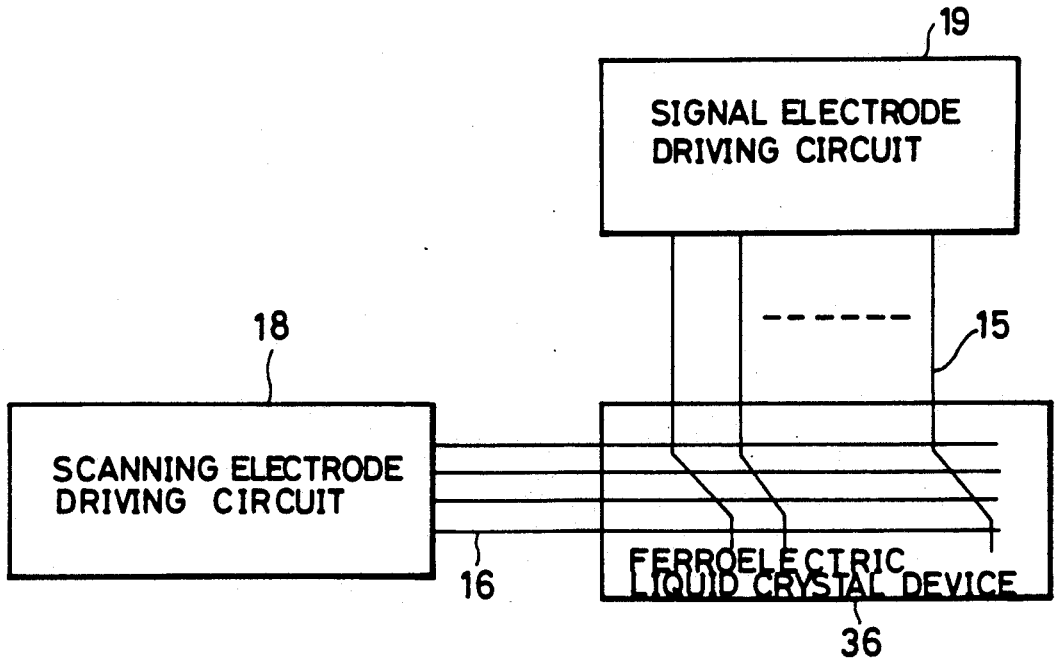
FIG. 11 is a block diagram showing a configuration of one form of the electrooptical apparatus including the electrooptical device and driving circuits therefor.

The exposure apparatus comprises an imaging lens 38, a ferroelectric liquid crystal device 36 and a light source 37 which are disposed in this order on a light-sensitive body 39. The ferroelectric liquid crystal device 36 is connected, for example, to a driving circuit as shown in FIG. 11 to constitute an electrooptical apparatus functioning as a light switch. When this electrooptical apparatus is used, light from the light source 37 is subjected to switching through respective picture elements to form an image on the light-sensitive body through the lens 38 for providing an electrostatic image according to the signal applied to a signal electrode.

In a general printing operation, image portions on which toner is applied are smaller in area than the remaining, background portions on which no toner is applied. Therefore, if a polarizer is controlled according to a developing method for the electrophotographic process to control the relationship between the polarity of the voltage applied and the light transmission state, the long-term reliability of the ferroelectric liquid crystal device can be improved. More particularly, in the case of normal development or charged-area development in which non-exposed areas form an image, light is cut off when the OFF-signal of FIG. 1 is applied to the signal electrode, and, in the case of reversal development or discharged-area development in which exposed areas form an image, light is transmitted when the OFF-signal of FIG. 1 is applied to the signal electrode, to reduce the application of the OFF-signal. In addition, the frequency of the application of symmetrical voltages is increased, resulting in further improvement of the long-term reliability of the ferroelectric liquid crystal. It is also effective to make all the scanning electrodes and the signal electrodes be substantially short-circuited to attain the same purpose.

One exemplary form of an optical logic element to which the present invention is applied will now be described.

Figure 32:
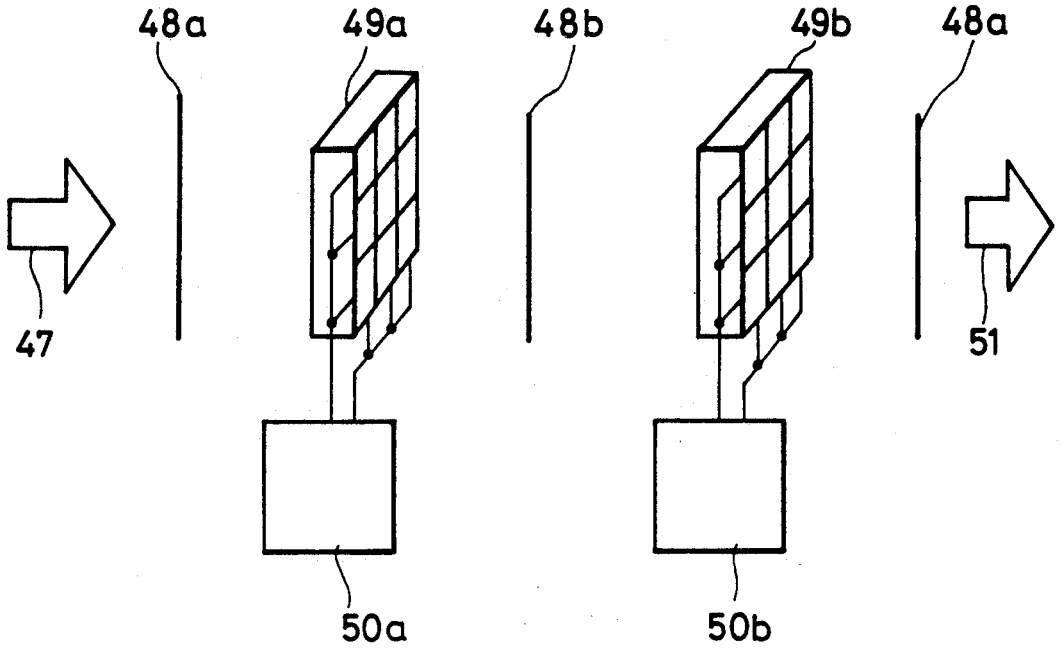
FIGS. 32 and 33 are explanatory views each showing an optical logic element employing the liquid crystal device.

The optical logic device as illustrated in FIG. 32 comprises two liquid crystal devices 49*a* and 49*b* and polarizers 48*a* and 48*b* whose polarization axes are perpendicular each other. More specifically, in the optical logic element, the polarizer 48*a*, the liquid crystal 49*a*, the polarizer 48*a*, the liquid crystal 49*b* and the polarizer 48*a* are disposed in series in this order along an optical axis, and liquid crystal driving circuits 50*a* and 50*b* are further provided for driving the liquid crystal devices 49*a* and 49*b*, respectively.

Figure 30:
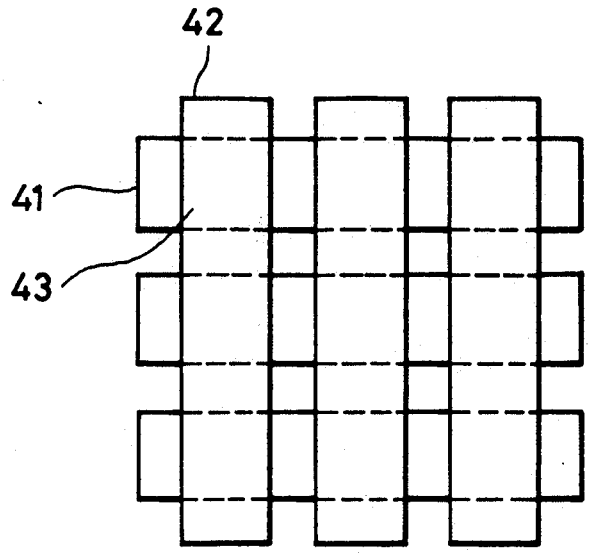
FIG. 30 is a plan view showing one form of a liquid crystal device constituting an optical logic element to which the present invention is applied.

The liquid crystal devices 49*a* and 49*b* are elements for constituting logic gates and have a two-dimensional configuration with scanning electrodes 41 and signal electrodes 42 arranged in matrix as illustrated in FIG. 30. The devices further have a three-dimensional structure as illustrated in FIG. 31, in which ferroelectric liquid crystal 45 is disposed between a glass plate 44 with scanning electrodes 41 and an alignment layer 43 and a glass plate 44 with signal electrodes 42 and an alignment layer 43.

Either of the scanning electrodes 41 and the signal electrodes 42 are transparent electrodes. The intersections of the electrodes 41 and 42 provide picture elements 43 for controlling light signals. The remaining portions where no electrodes are provided or only one of the electrodes are provided do not constitute picture elements and can not control light. Therefore, the portions which do not constitute the picture elements are preferably covered with shielding masks 46.

In the optical logic element shown in FIG. 32, coherent beams of light 47 such as laser beams become light signals representing two, light- and dark-states, respectively, through the liquid crystal device 49*a* in which the states of the picture elements are set by the liquid crystal driving circuit 50*a*, according to said states of the picture elements, and the signals are controlled by the liquid crystal device 49*b* in which the picture elements are set by the liquid crystal driving circuit 50*b*. This operation is summarized in FIG. 34. Only when the picture elements of both the liquid crystal devices 49*a* and 49*b* are in the light-states, an output generated is indicative of light-state. Therefore, if it is assumed that the light-state is "1" and the dark-state is "0", the optical logic element shown in FIG. 32 function as an AND element.

Figure 31:
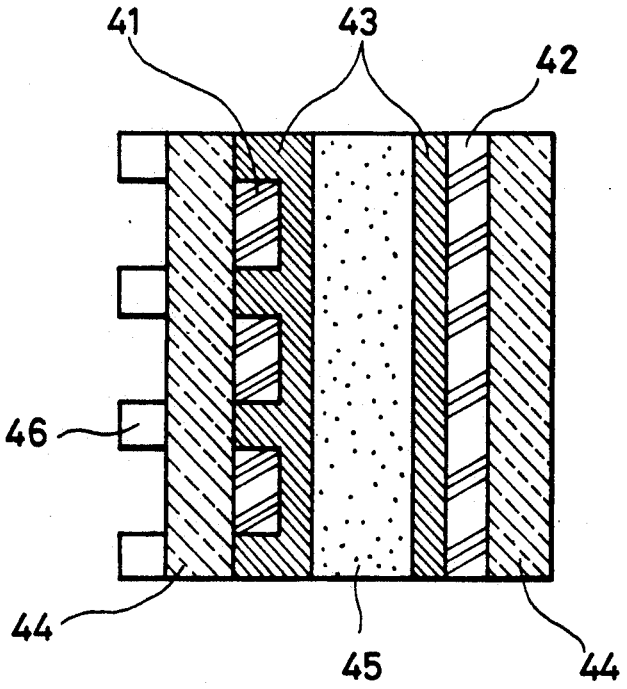
FIG. 31 is a sectional view of the liquid crystal device shown in FIG. 30.
Figure 33:
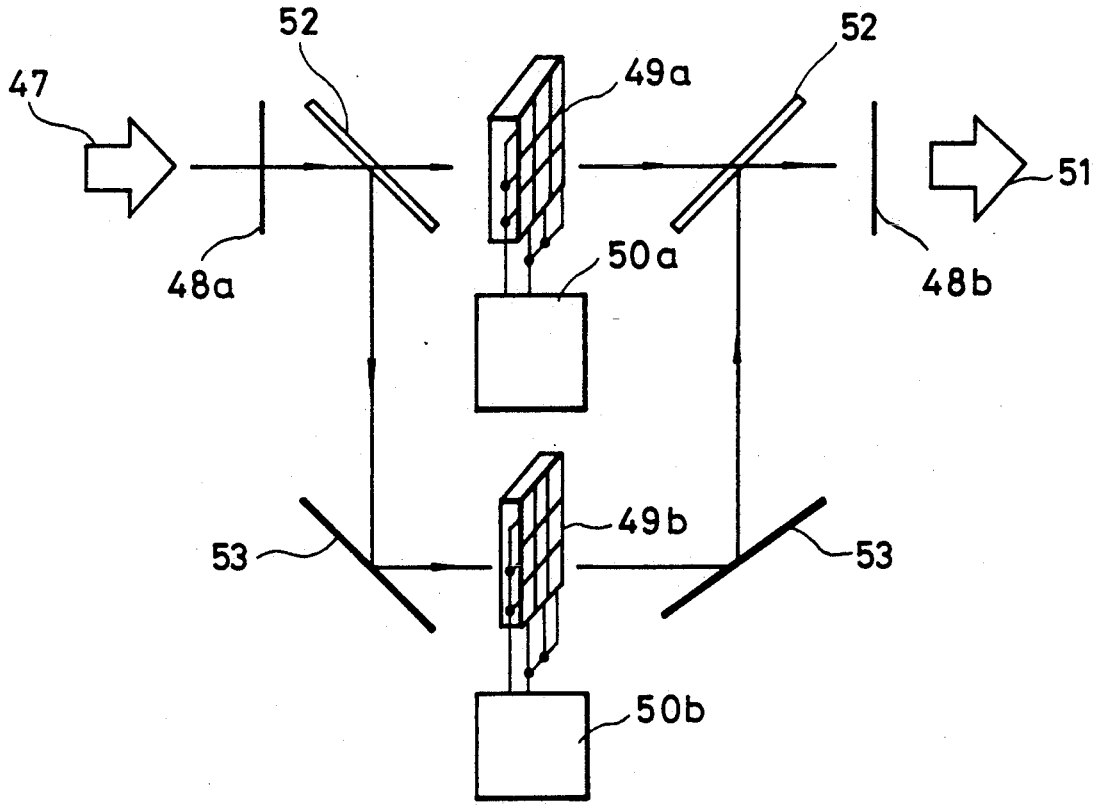

The two liquid crystal devices 49*a* and 49*b* having the configuration shown in FIG. 31 and the two polarizers 48*a* and 48*b* whose polarization axes are perpendicular with each other are arranged as illustrated in FIG. 33 to constitute another type of optical logic element. More specifically, the liquid crystal devices 49*a* and 49*b* are arranged in parallel and two splitters 52 and two reflectors 53 are provided to split coherent beams of light 47, allowing the split beams to transmit through the respective liquid crystal devices 49*a* and 49*b* and be synthesized again for an output.

With this arrangement, coherent beams of light 47 such as laser beams are split into two directions by the beam splitter 52 after being transmitted through the polarizer 48*a* and become optical signals representing dark- and light-states by the liquid crystal device 49*a* in which the states of the picture elements are set by the liquid crystal device driving circuit 50*a* and the liquid crystal device 49*b* in which the states of the picture elements are set by the liquid crystal device driving circuit 50*b*, according to the respective states of the corresponding picture elements. The optical signals from the liquid crystal devices 49*a* and 49*b* are synthesized into an output 51 by the reflector 53 and the beam splitter 52. The operation is summarized in FIG. 35. More specifically, only when both the picture element of the liquid crystal device 49*a* and the picture element of the liquid crystal device 49*b* are in the dark-states, an output produced is of a dark-state. If it is assumed that the light-state is "1" and the dark-state is "0", the optical logic element of FIG. 33 functions as an OR element.

The corresponding relationship between the light- and dark-states and "0" and "1" may be reversed so that the light-state may be indicative of "0" and the dark-state may represent "1". In this case, the device of FIG. 32 functions as an OR element and the device of FIG. 33 functions as an AND element.

For the liquid crystal devices used as the optical logic elements as described above, the waveforms as shown in FIGS. 1 and 21 to 27 may be employed. In this case, however, the state setting voltage may be applied only to the picture or pictures which is or are needed to be overwritten. Therefore, it suffices to apply the waveform for the selected period only to a scanning electrode or electrodes having a picture element or elements which is or are to be overwritten, while the waveform for the non-selected period is applied to the remaining scanning electrodes. Thus, it is not always necessary to apply the waveform for the selected period sequentially to all the scanning electrodes.

Although two liquid crystal devices are used in the optical logic elements as described above, three or more liquid crystal devices may also be employable for attaining the object.

The present invention may further be applied to electronic systems employing the display as described above, such as an information input/output equipment, for example, a personal computer, a word processor, etc., or an optical computer employing the optical logic elements as described above.

Although the electrooptical devices as described above comprise electrodes arranged in matrix and used as signal and scanning electrodes, the manners in which the electrodes are used are not limited to such an arrangement. Further, the present invention is not limited by the names of the electrodes. For example, the electrodes may be named column and row electrodes, or first and second electrodes according to the use of the device.

Further, the present invention is not limited to the device of the matrix configuration, but it is applicable to devices of various configurations.

In the driving waveforms as used in the foregoing embodiments, the polarity is defined with reference to 0V. However, the level of the 0V is not absolute and can set appropriately according to the necessity of power supply unit etc. For example, the level of $-2V_0$ may be assumed as a potential of 0V. In brief, it suffices that the electrooptical material can be applied with a DC voltage or high-frequency AC voltage of a desired polarily.

An intermediate electrode may further be provided between the scanning electrode and the signal electrode in the device of the present invention. This enables, for example, tonal control.

Other embodiments

According to the driving method of the first feature of the present invention, the integration value of the voltages applied is offset to one polarity. It is desirable for improving the reliability of the electrooptical material to reduce the offset. To attain this, the electrooptical device may have such functions as to freely select a light-transmitting state or light-cutting off state in response to the application of a voltage to the electrooptical material. This function could be imparted, for example, if the polarizer 1 in the ferroelectric liquid crystal device shown in FIG. 2 has such a property that it can freely control the polarization direction. The polarizers of this type may be such that it shows rotatory polarization which rotates the polarization plane, where in the rotatory polarization is controllable externally, and they may include a magnetic garnet thin film showing a Faraday effect or a twisted nematic liquid crystal.

The following variety of driving methods can be employed when the polarizers of the above-mentioned properties are used.

Variety 1

When the electrooptical device is used as the light switch array for the printer, all print data for one complete printing page, and, when it is used for the display, all data for one complete frame, are once stored in a storage. Thereafter, the minority of the two optical states, either of which the respective picture elements assume corresponding to the data, is detected. The ON or OFF driving waveforms are then determined according to the detection result. In the driving method according to the first feature of the present invention, a DC voltage pulse of the same polarity as the polarity of the bias voltage which may possibly be superposed on the high-frequency AC voltage during the OFF-time of the signal electrode is used for developing the minor optical state. This driving method is effective to suppress such unbalance that the polarities of the voltages applied to the electrooptical material are one-sided. In this connection, it is to be noted that the "minor optical states" used here means that the number of the picture elements assuming said optical state is smaller than that of the picture elements assuming the other optical state.

Figure 36:
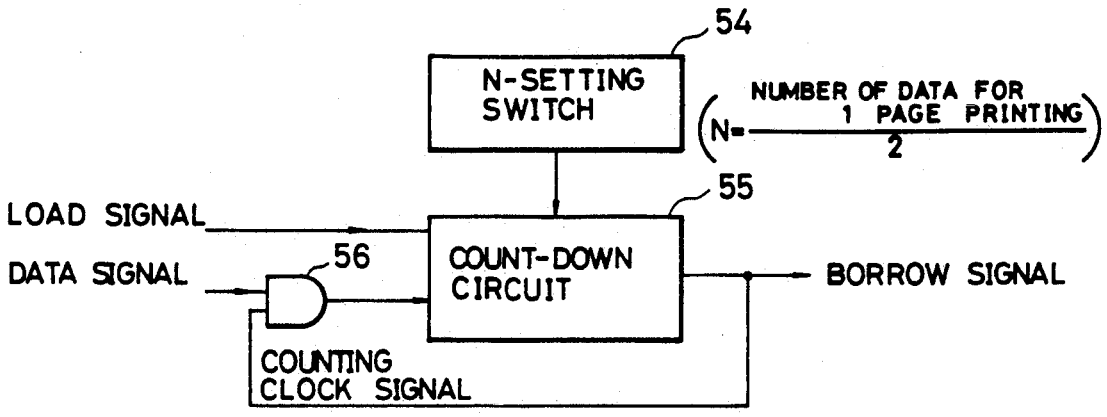
FIG. 36 is a block diagram, showing one form of a determination circuit for determining an optical state of picture elements in the minority.

To determine the minor optical state, a determination circuit as illustrated in FIG. 36 may be used. This determination circuit comprises a value N setting switch 54 for setting a value N, which is ½ of the number of the data for one complete page printing, in a count-down circuit 55 as an initial value. The count-down circuit 55 counts data signal, while decreasing one count in response to every data signal used as counting clock signals. An AND gate 56 is connected to a data input of the count-down circuit 55. A borrow signal to the count-down circuit 55 and the data signal are ANDed by the AND gate 56.

The operation of the determination circuit will now be described, with reference to the light switch array for a printer employing the ferroelectric liquid crystal.

The value N is first set in the count-down circuit 55 as the initial value by the value N-setting switch 54. Then, the data signals are inputted to the count-down circuit 55 as the counting clock signals to decrease one count from the initial value upon every input of the data signals. While the data signal having the waveform of FIG. 17(*a*) is used as an ON-signal for putting the picture element of the light switch array into a light-transmitting state, the data signal having the waveform of FIG. 17(*b*) is used as an OFF-signal for putting the picture element of the light switch array into the light-cutting off state. Therefore, the value is decreased one count upon every input of the OFF-signal until the number of the OFF-signal reaches the value N, when a borrow signal (of low level) is outputted.

Figure 37:
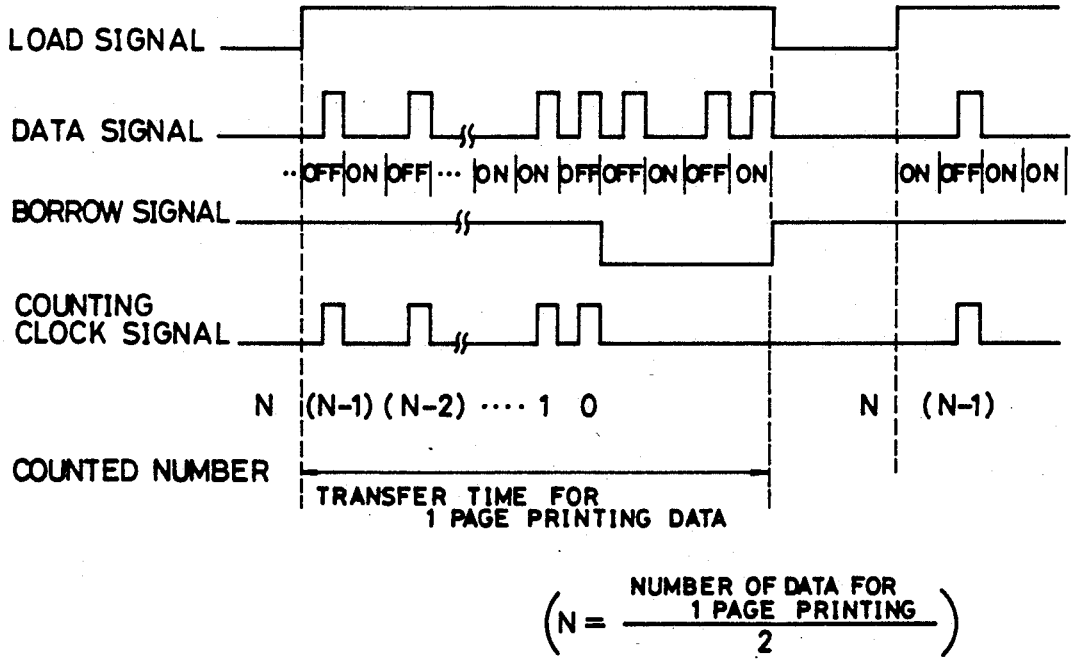
FIG. 37 is a timing chart for showing an operation of the determination circuit.

The timing chart showing the operation of the determination circuit is given in FIG. 37. When the borrow signal becomes low, the counting of the OFF-signals of the data signals is suspended until further initiation of input for the next page printing. This control is made by a load signal as can be seen from FIG. 37.

With the arrangement of the circuit as described above, it can be determined which is major in number among the data for one page printing, the ON-signals or the OFF-signals.

Figure 2:
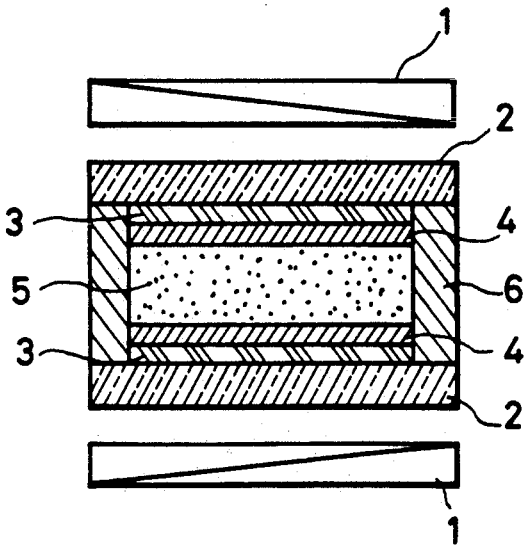
FIG. 2 PRIOR ART
FIG. 2 is a sectional view of a general configuration of ferroelectric liquid crystal device.
Figure 3:
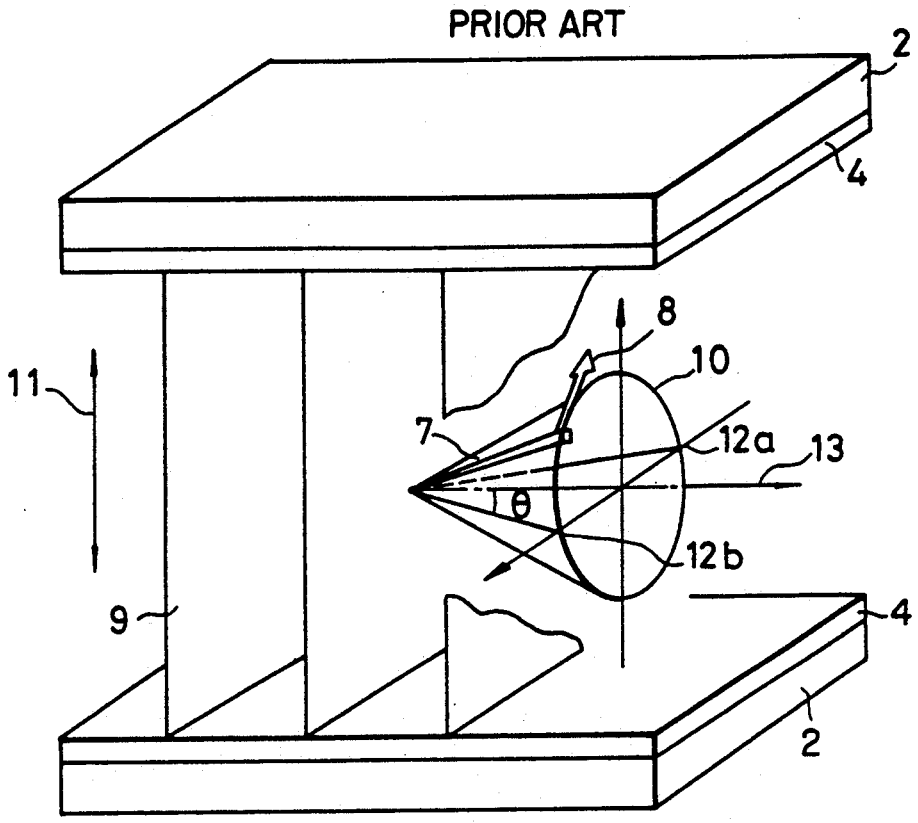
FIG. 3 PRIOR ART
FIGS. 3 and 4(*a*)–4(*b*) are explanatory views showing an operation of a general ferroelectric liquid crystal responsive to an electric field.
Figure 4A:
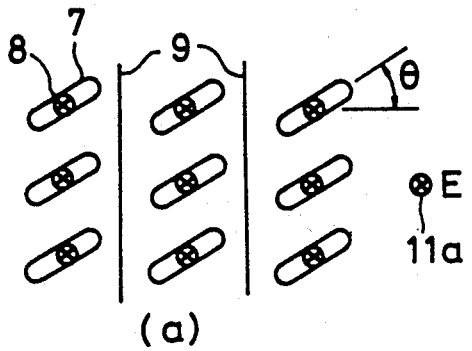
FIG. 4(a) PRIOR ART
Figure 4B:
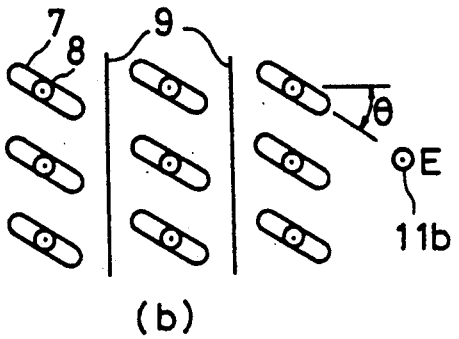
FIG. 4(b) PRIOR ART
Figure 5:
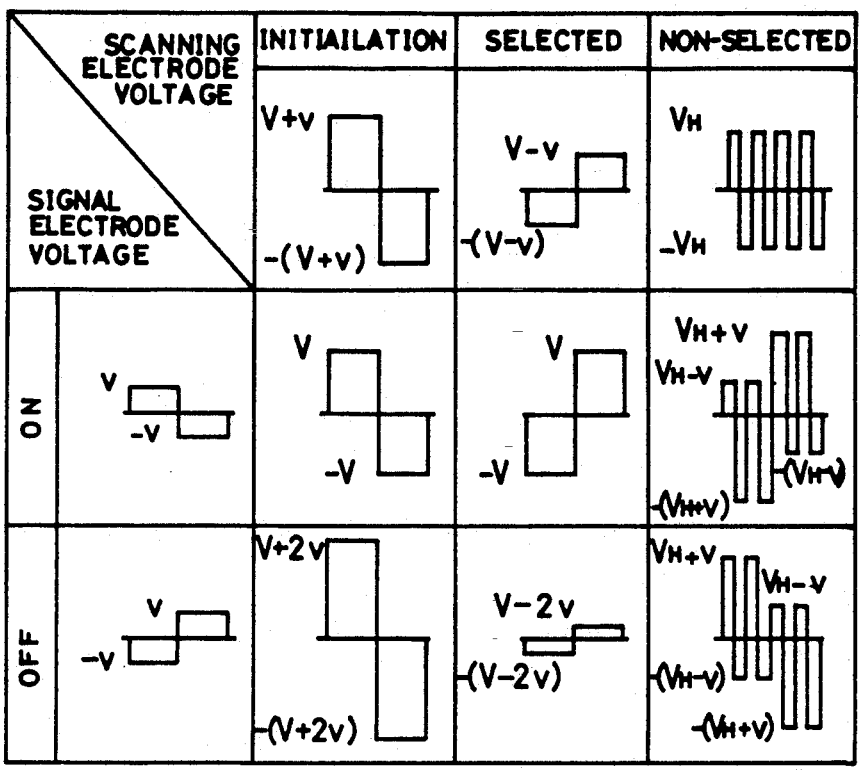
FIG. 5 PRIOR ART
FIGS. 5 and 6 are explanatory views showing a set of drive waveforms used for conventional driving methods.
Figure 6:
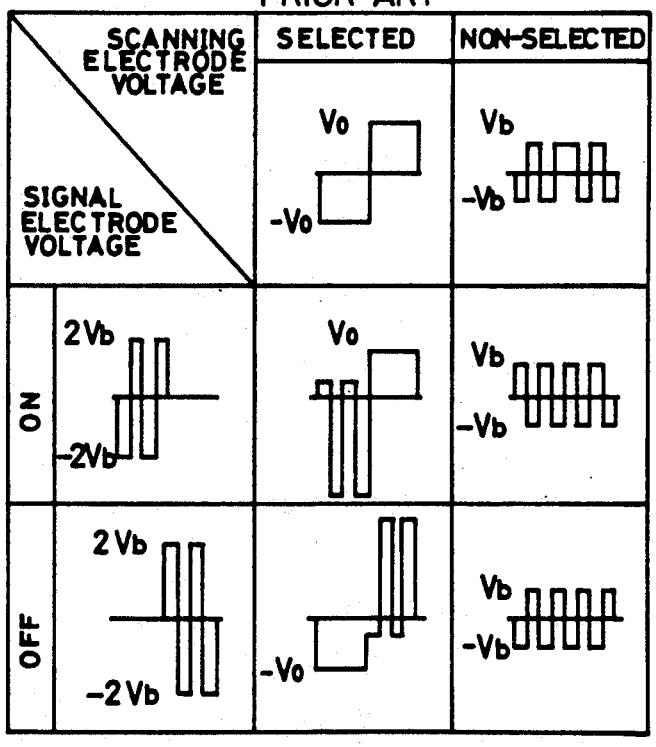
FIG. 6 PRIOR ART
Figure 7A:
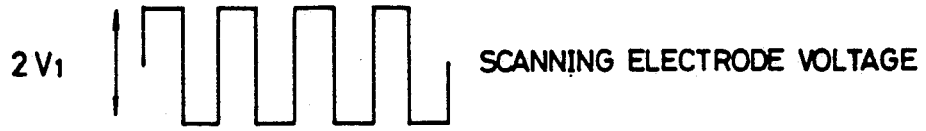
FIGS. 7(*a*)–7(*c*) and 8(*a*)–8(*c*) are waveform diagrams shown for explanation of the first mode of the driving method.
Figure 7B:
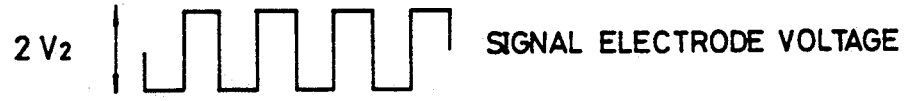
Figure 7C:
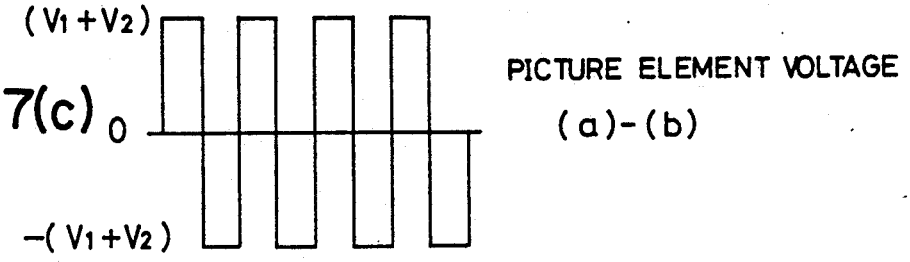
Figure 8A:
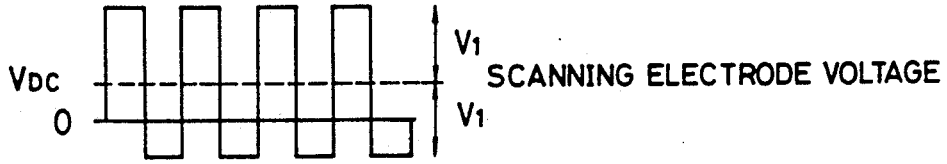
Figure 8B:
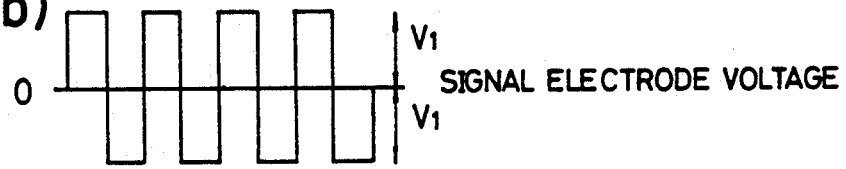
Figure 8C:
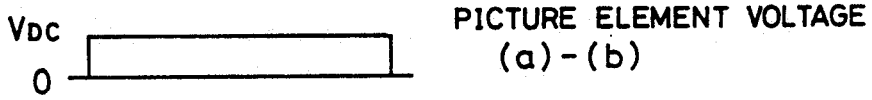
Figure 9A:
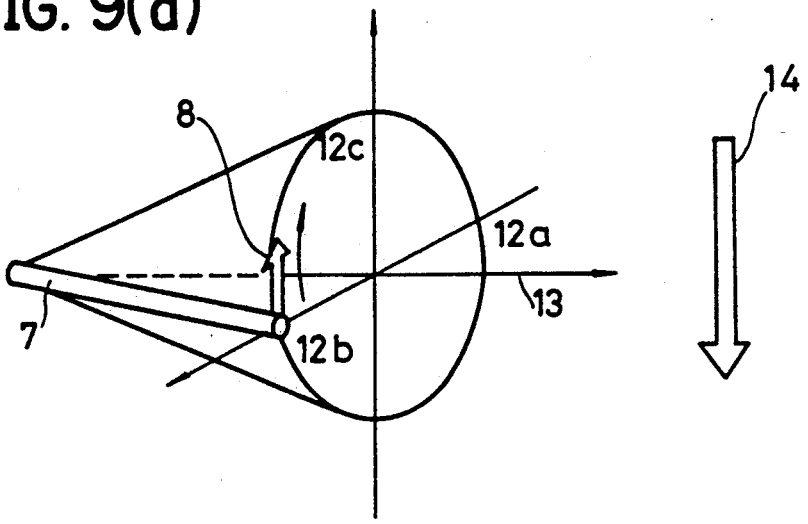
FIGS. 9(*a*)–9(*c*) are explanatory view for showing an operation of the driving method according to the present invention.
Figure 9B:
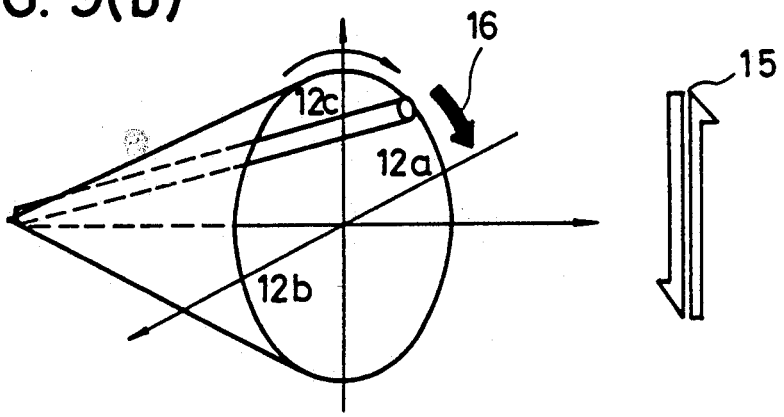
Figure 9C:
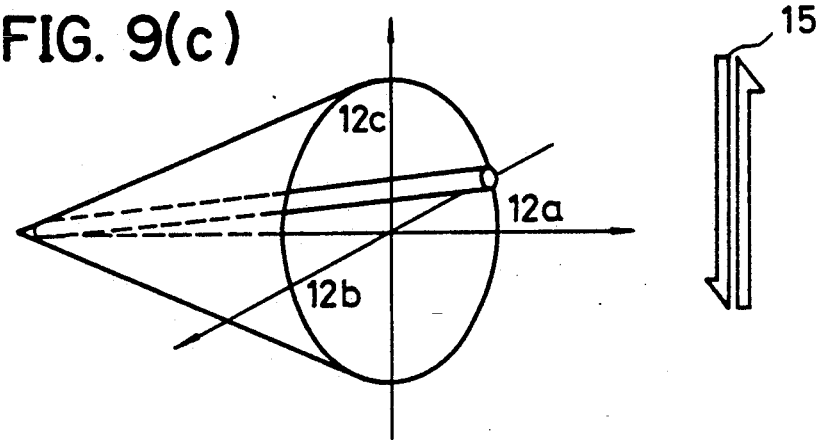

More particularly, if the borrow signal is at a high level after completion of input of the data for one page, it indicates that the ON-signal is in the majority. Therefore, when the ON-signal is applied to the signal electrode, it is controlled that symmetrical, positive and negative voltage pulses may be applied to the ferroelectric liquid crystal. More illustratively, the polarization characteristics of the polarizer is adjusted so that the light-transmitting state may occur when a voltage of positive polarily is applied to the ferroelectric liquid crystal as shown in FIG. 2 and the ON-signal voltage and the OFF-signal voltage of FIG. 1 is applied to the signal electrodes.

On the other hand, if the borrow signal is at a low level after completion of input of the data for one page, it indicates that the number of the OFF-signals is equal to or larger than the number of the OFF-signals. Therefore, when the OFF-signal is applied to the signal electrode, it is so controlled that symmetrical voltage pulses may be applied to the ferroelectric liquid crystal. More particularly, the polarization characteristics of the polarizer are adjusted so that the light-transmitting state may occur when a voltage of negative polarity is applied to the ferroelectric liquid crystal shown in FIG. 2, and voltage waveforms similar to those of FIG. 1 but different in that the ON-signal voltage and the OFF-signal voltage to be applied to the signal electrodes are exchanged with each other, and are applied to the signal electrodes.

According to the operations as described, undesired application of voltages unsymmetrical with respect to the 0 level can be minimized.

Variety 2

Whenever printing of the data for one page has been completed, in the case of the light switch array for a printer, and whenever display of the data for one frame has been completed, in the case of the display, the relationship between the polarity of the voltage applied to the electrooptical material and the resultant optical state of the electrooptical apparatus is reversed. For example, if reference is made to the display, the light-transmitting state is provided during one scanning by a voltage of positive polarity and the light-cutting off state is provided during the succeeding scanning by the voltage of positive polarity. This can reduce the undesired unbalance of the polarities of the voltages applied to the electrooptical material.

The foregoing example is given for a light printer of normal development or charged-area development in which a white image is obtained when light is transmitted through the light switch array (in the ON-state). The present invention is still operative for a system in which the relationship between the darkness and the lightness is reversed. The example of the light printer is again referred to, and it is confirmed that the present invention is also operative for the printer of reversal development or discharged-area development, in which the area which has been irradiated by light becomes a black image.

Chromatic printing is similar in principle to the non-chromatic printing as described above. It is now assumed that colors include black and that white and an image is formed by a color of a material to be printed and another color different from the former color. In this case, areas on which light is irradiated form a desired image by the color of the material to be printed. Alternatively, the areas irradiated by light form an image by said another color different from the former color of the material to be printed.

In this connection, it is to be noted that the definition of the wording "contrast" is made with respect to a contrast between dark and light patterns provided by transmitted light through the light switch array. On the other hand, final patterns may also be formed by reversing the relationship between the darkness and lightness and the transmitted light through the array. In this case, the definition of the wording should be changed to the final patterns. For example, the definition as given above should be interpreted to the contrast of the finally obtained printed image for an optical printer of the reversed development type.

According to the present invention as described above, the following effects can be obtained:

(1) The high-frequency AC voltage applied to hold the state of the picture element in the electrooptical device is symmetrical with respect to negative and positive or 0 level. Or, even when a bias voltage is superposed, the voltage applied is always of the same polarity as the AC voltage used for causing an optical state which does not lower the contrast and it is intermittent. This assures high contrast by a low voltage.

(2) The DC voltage pulse applied to determine the state of the picture element in the electrooptical device during the selected period can be lowered. This is also effective to realize high contrast by a low voltage.

(3) The high-frequency voltage pulses are applied both to the scanning electrodes and to the signal electrodes, so that the high-frequency AC voltage applied to hold the state of the picture element in the electrooptical device can be higher than the high-frequency voltage pulses applied to the scanning electrodes and the signal electrodes. This again assures high contrast by a low voltage.

The present invention further provides the following effects:

(1) The driving method of the present invention enables provision of an electrooptical device which is capable of assuring high contrast with a low voltage.

(2) The electrooptical device according to the present invention, in turn, enables provision of an electrooptical apparatus which is capable of providing high contrast with a low voltage.

What is claimed is:

1. A driving method for an electrooptical device including one or more cells which comprises an electrooptical material showing different responsive states, depending upon a direction of an electric field applied thereto and a pair of electrodes for applying a voltage to the electrooptical material, which method comprises:

setting the electrooptical material to a desired responsive state, said setting of the electrooptical material including applying, to one of the electrode pair, a high-frequency AC voltage on which DC voltage pulses of polarities corresponding to said different responsive states, respectively, are superposed during a first half of a period for setting the responsive states and a latter half of the period, respectively, and applying, to another of the electrode pair, a high-frequency AC voltage which cancels all the high-frequency AC voltage applied to said one of the electrode pair, or a voltage containing multiplexedly a high-frequency AC voltage and a DC voltage which cancel part of the high-frequency AC voltage and part of the DC voltage applied to said one of the electrode pair, corresponding to the first half and latter half of the setting period, respectively, thereby to set said electrooptical material to a desired responsive state.

2. A driving method for an electrooptical device according to claim 1, in which the high-frequency AC voltage applied to one of the electrode pair is in phase with the high-frequency AC voltage applied to another of the electrode pair.

3. A driving method for an electrooptical device according to claim 1, in which the electrode pairs each comprise a scanning electrode and a signal electrode which are arranged to intersect each other, the intersection of the electrodes being adapted to function as an electrode for applying a voltage to the electrooptical material, the number of the electrodes for applying the voltage to the electrooptical material being determined by the number of the intersections formed by the scanning and signal electrodes.

4. An electrooptical apparatus comprising an electrooptical device which includes an electrooptical material showing different optical states depending upon a polarity of a voltage applied thereto and one or more cells each including a pair of electrodes for applying a voltage to the electrooptical material, and driving means for applying voltages to said pair of electrodes of each cell, said driving means comprising means for applying high-frequency AC voltages of the same frequency and out of phase by 180° to the pair of electrodes for the cell or cells of the electrooptical device which is or are to be held in a previously set optical state, and means for applying a high-frequency AC voltage of the same frequency, phase and amplitude and having a difference corresponding to a DC bias voltage which changes the cell or cells to a desired state, to the pair of electrodes for the cell or cells.

5. An electrooptical apparatus according to claim 4, in which said electrooptical material is a ferroelectric liquid crystal.

6. An electrooptical device according to claim 4, in which said electrooptical material is a ferroelectric liquid crystal having a dielectric anisotropy $\Delta\epsilon$.

7. A driving method for an electrooptical device comprising one or more cells each including an electrooptical material showing different responsive states depending upon a direction of an electric field applied thereto and a pair of electrodes for applying voltages to the electrooptical material, which method comprises:

setting the electrooptical material to a desired responsive state;

the setting comprising:

applying, to one of the electrode pair, a high-frequency AC voltage on which DC voltage pulses corresponding to the different responsive states, respectively, are superposed in a first half and a latter half of a state setting period, and applying, to another of the electrode pair, a high-frequency AC voltage which cancels all the high-frequency AC voltage applied to said one of the electrode pair, or a voltage containing a high-frequency AC voltage and a DC voltage which cancels a part of the high-frequency AC voltage and a part of the DC voltage applied to said one of the electrode pair, respectively, in the first half and the latter half of the state setting period, respectively; and holding the electrooptical material in the desired responsive state;

the holding comprising:

applying a high-frequency AC voltage to said one of the electrode pair, and applying a high-frequency AC voltage or a high-frequency AC voltage including partly during the application period, a DC voltage pulse of a polarity which does not cause a change in the responsive states.

8. A driving circuit for an electrooptical device comprising one or more cells each including an electrooptical material showing different optical states in response to a polarity of an electric field applied thereto and one or more electrode pairs for applying a voltage to the electrooptical material, said driving circuit applying a voltage to said one or more electrode pairs, which circuit comprises:

means for applying a high-frequency AC voltages of substantially the same frequency and substantially inverted phase to the electrode pair or pairs of the electrooptical device which is or are to be held in a present optical state; and means for applying high-frequency AC voltages of substantially the same frequency, phase and amplitude and having a difference corresponding to a DC bias voltage which is capable of setting the electrooptical device to a desired optical state to the electrode pair or pairs which are to be set in the desired optical state.

* * * * *